US009267275B2

(12) United States Patent
Schuster et al.

(10) Patent No.: US 9,267,275 B2
(45) **Date of Patent: *Feb. 23, 2016**

(54) DUAL FLUSH HANDLE CONTROL

(71) Applicant: Danco, Inc., Irving, TX (US)

(72) Inventors: Michael J. Schuster, Shorewood, IL (US); Douglas C. Saunders, Shorewood, IL (US); Duston E. A. Stutzman, Shorewood, IL (US)

(73) Assignee: DANCO, INC., Irving, TX (US)

( * ) Notice: Subject to any disclaimer, the term of this patent is extended or adjusted under 35 U.S.C. 154(b) by 12 days.

This patent is subject to a terminal disclaimer.

(21) Appl. No.: 13/826,321

(22) Filed: Mar. 14, 2013

(65) Prior Publication Data

US 2013/0191981 A1 Aug. 1, 2013

Related U.S. Application Data

(63) Continuation-in-part of application No. 13/302,924, filed on Nov. 22, 2011.

(60) Provisional application No. 61/610,897, filed on Mar. 14, 2012.

(51) Int. Cl.

| | |
|---|---|
| ***E03D 5/00*** | (2006.01) |
| ***E03D 3/12*** | (2006.01) |
| ***E03D 5/02*** | (2006.01) |

(52) U.S. Cl.

CPC .. *E03D 3/12* (2013.01); *E03D 5/00* (2013.01); *E03D 5/02* (2013.01)

(58) Field of Classification Search

CPC ..... E03D 5/092; E03C 1/06
USPC ..... 4/300–486
See application file for complete search history.

(56) References Cited

U.S. PATENT DOCUMENTS

| | | | |
|---|---|---|---|
| 3,345,649 | A | 10/1967 | Cabra |
| 4,154,221 | A | 5/1979 | Nelson |
| 4,305,163 | A | 12/1981 | Raz |
| 4,530,119 | A | 7/1985 | Chiu et al. |
| 4,733,416 | A | 3/1988 | Ott |
| 4,750,220 | A | 6/1988 | Baumann |
| 4,906,922 | A | 3/1990 | Takahashi et al. |
| 4,922,194 | A | 5/1990 | Gaussa et al. |
| 4,969,218 | A | 11/1990 | Comparetti |

(Continued)

FOREIGN PATENT DOCUMENTS

WO WO2007139371 12/2007

OTHER PUBLICATIONS f;Schuster et al., U.S. Appl. No. 13/307,809, filed Nov. 30, 2011, Non-Final Office Action dated Feb. 3, 2015 and Response filed May 4, 2015.

Schuster et al., U.S. Appl. No. 13/307,809, filed Nov. 30, 2011, Final Office Action Dated Aug. 31, 2015.

Schuster et al., U.S. Appl. No. 12/986,729, filed Jan. 7, 2011, Non-Final Office Action dated May 9, 2014 and response filed Aug. 8, 2014.

(Continued)

*Primary Examiner* — Lori Baker

(74) *Attorney, Agent, or Firm* — Thomas | Horstemeyer, LLP; Michael J. D'Aurelio; Randy R. Schoen

(57) ABSTRACT

Disclosed are various embodiments for a dual flush handle system. A first handle lever is configured to rotate in a direction by a first predetermined angle of rotation to initiate a first flush of a toilet. A second handle lever is configured to rotate in the direction about a second predetermined angle of rotation to initiate a second flush of a toilet.

20 Claims, 28 Drawing Sheets

(56) References Cited

U.S. PATENT DOCUMENTS

| | | | | |
|---|---|---|---|---|
| 5,117,513 | A | 6/1992 | Burrowes | |
| 5,140,712 | A | 8/1992 | Wang-On | |
| 5,301,373 | A * | 4/1994 | Hull et al. | 4/325 |
| 5,319,809 | A | 6/1994 | Testa | |
| 5,375,268 | A | 12/1994 | Chen | |
| 5,396,665 | A | 3/1995 | Raz et al. | |
| 5,491,848 | A | 2/1996 | Wang | |
| 5,659,903 | A | 8/1997 | Hammarstedt | |
| 5,680,659 | A | 10/1997 | Gessaman | |
| 5,819,330 | A | 10/1998 | Yokel | |
| 6,163,897 | A | 12/2000 | Plas et al. | |
| 6,263,520 | B1 | 7/2001 | Song | |
| 7,062,801 | B2 | 6/2006 | Oliver | |
| 2005/0283894 | A1 | 12/2005 | Oliver | |
| 2007/0079432 | A1 | 4/2007 | Shoikhet et al. | |
| 2007/0163034 | A1 | 7/2007 | Ogen | |
| 2010/0132104 | A1 | 6/2010 | Csiki | |
| 2011/0107506 | A1 | 5/2011 | Nasrallah | |
| 2011/0203042 | A1 | 8/2011 | Roberts et al. | |
| 2013/0191981 | A1 | 8/2013 | Schuster et al. | |

OTHER PUBLICATIONS

Schuster et al., U.S. Appl. No. 12/986,729, filed Jan. 7, 2011, Non-Final Office Action dated Dec. 4, 2014 and response filed Mar. 3, 2015.

Schuster et al., U.S. Appl. No. 12/986,729, filed Jan. 7, 2011, Final Office Action dated Jul. 2, 2015 and repsonse filed Sep. 16, 2015.

Schuster et al., U.S. Appl. No. 13/272,778, filed Oct. 13, 2011, Non-Final Office Action dated Aug. 29, 2014 and response filed Dec. 1, 2014.

Schuster et al., U.S. Appl. No. 13/272,778, filed Oct. 13, 2011, Non-Final Office Action dated Mar. 27, 2015 and response filed May 27, 2015.

Schuster et al., U.S. Appl. No. 13/272,778, filed Oct. 13, 2011, Final Office Action dated Sep. 15, 2015 and repsonse filed Oct. 1, 2015.

Schuster et al., U.S. Appl. No. 13/302,924, filed Nov. 22, 2011, Non-Final Office Action dated Dec. 3, 2014 and response filed Mar. 3, 2015.

International Search Report and Written Opinion, dated Mar. 15, 2011 for PCT/US2011/020497.

* cited by examiner

Neutral Position

Rotation of the short handle is limited by the shoulder making contact with the stop Initiating Quick Flush Rotation of the long handle is limited by the stop making contact with the end of the slot Initiating Full Flush The keyed opening is rotatably offset from the protrusions of the shaft when dual flush handle control is in the neutral position.

The keyed opening is rotatably offset from the protrusions of the shaft when dual flush handle control is in the neutral position.

Neutral Position

Rotation of the short handle is limited by the extension making contact with the edge of the cut-out Initiating Quick Flush Rotation of the long handle is limited by the extension making contact with the edge of the slot Initiating Full Flush Neutral Position Initiating Quick Flush Initiating Full Flush Neutral Position Initiating Quick Flush Initiating Full Flush Neutral Position Initiating Quick Flush Initiating Full Flush

DUAL FLUSH HANDLE CONTROL

CROSS REFERENCE TO RELATED APPLICATIONS

This application claims priority to U.S. provisional application entitled "DUAL FLUSH HANDLE CONTROL" having Ser. No. 61/610,897, filed Mar. 14, 2012, the entirety of which is hereby incorporated by reference. This application is also a continuation-in-part of co-pending U.S. patent application entitled "DUAL FLUSH HANDLE CONTROL" having Ser. No. 13/302,924, filed Nov. 22, 2011, the entirety of which is hereby incorporated by reference.

BACKGROUND

Most dual flush toilet systems are provided as a package including a dual flush assembly and activation device to initiate operation of the dual flush assembly in one of the dual flush modes. In many instances, the activation control may not be preferred by the customer.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
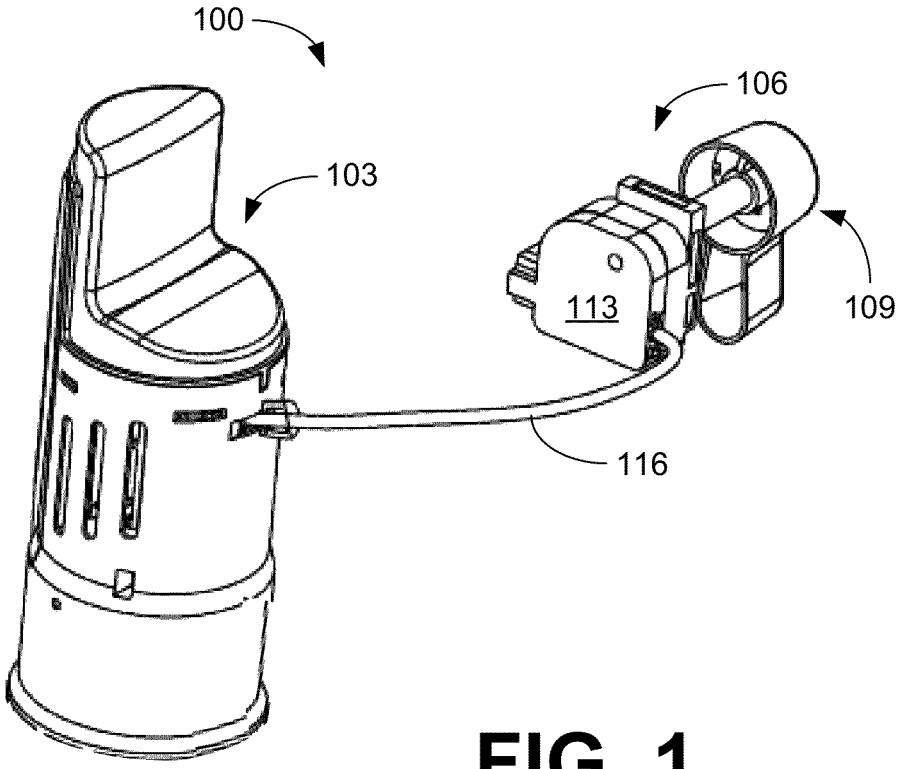
FIG. 1 is a drawing of a dual flush toilet system with rotational activation of a dual flush assembly in accordance with various embodiments of the disclosure.

With reference to FIG. 1, shown is a dual flush toilet system 100 including a dual flush assembly 103 and an activation assembly 106 to initiate operation of the dual flush assembly 103 in one of the dual flush modes: quick flush for liquids and full flush for solids. In the embodiment of FIG. 1, the activation assembly 106 includes a rotary handle assembly 109 that is detachably connected to an actuation control box 113. The exemplary actuation control box 113 is in communication with the dual flush assembly 103 through a cable assembly 116, which is connected to the actuation control box 113 and the body of the dual flush assembly 103. The rotary handle assembly 109 is detachably connected to actuation control box 113. For example, the rotary handle assembly 109 may be engaged with the actuation control box 113 by a spring-loaded clip assembly. By actuating the clip assembly, the rotary handle assembly 109 may be detached from the actuation control box 113.

Figure 2A:
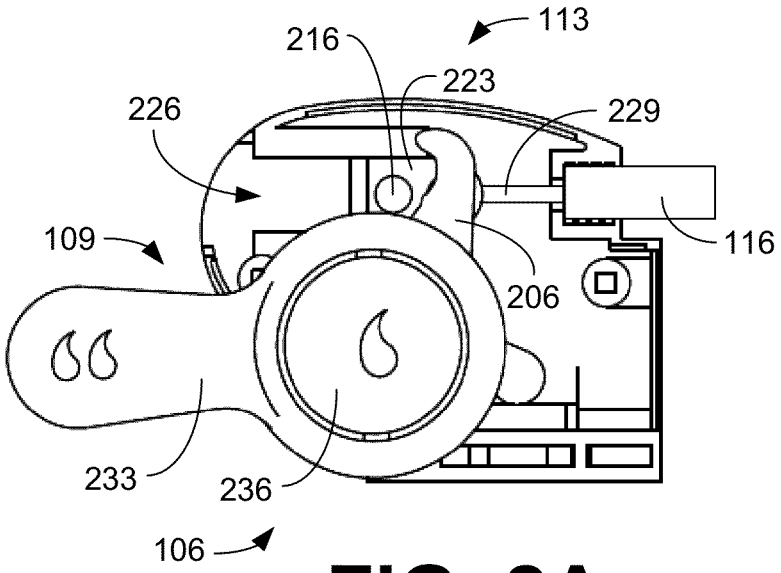
FIGS. 2A-2C are drawings of an example of a dual-input activation assembly for use in the dual flush toilet system of FIG. 1 in accordance with various embodiments of the disclosure.
Figure 2B:
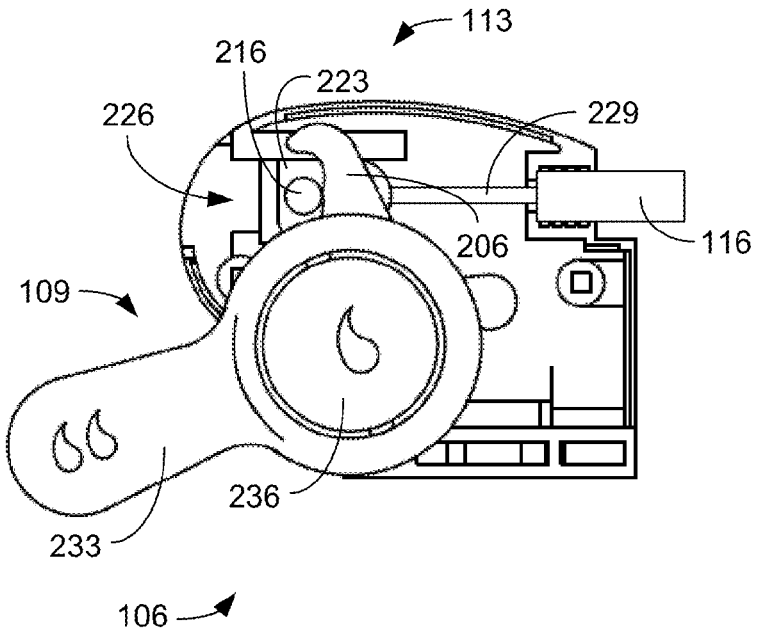
Figure 2C:
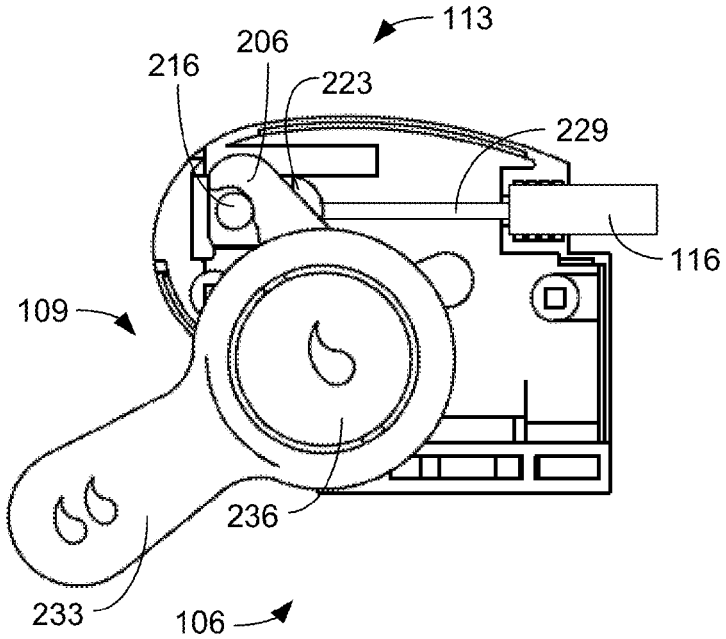

Operation of an example of an activation assembly 106 is discussed with reference next to FIGS. 2A-2C. FIG. 2A illustrates the activation assembly 106 in a neutral position. When the actuation control box 113 is in a neutral position, the handle lever 233 is in a neutral position. In the embodiment of FIG. 2A, the handle lever 233 is in a horizontal position. In the neutral position, the cable 229 is retracted in cable assembly 116 and the cable anchor 223 is at a neutral position in the linear guide path 226.

A rotational force provided through a stem of the handle lever 233 is transferred through a cam to the cable anchor 223 in the linear guide path 226 by an anchor arm 206. The anchor arm 206 may be configured to exert an initial breakaway force on the cable anchor 223, followed by a reduced translation force. In one embodiment, the higher breakaway force is exerted at a breakaway point of the anchor arm 206 on a breakaway shoulder of the cable anchor 223. As the cable anchor 223 moves along the linear guide path 226, the cam rotates about the rotational axis until the anchor arm 206 engages a translation pin 216 at a second position on the anchor arm 206.

Further rotation of the cam 229 exerts a reduced translation force on the cable anchor 223 though the translation pin 216 because of an increased lever arm length. Anchor arm 206 disengages with the breakaway shoulder, removing the breakaway force from the cable anchor 223. Counter clockwise rotation of the handle lever 233 is illustrated in FIGS. 2B and 2C. Depressing handle button 236 before rotating handle lever 233 restricts the rotation of the activation control assembly 103, to the intermediate quick flush position as illustrated in FIG. 5E. Rotating the handle lever 233 without depressing the handle button 236 initiates a full flush of the dual flush assembly 103 by allowing the handle lever 233 to be rotated in a counter clockwise direction beyond the quick flush restriction point. FIG. 2C illustrates the handle lever 233 rotated to the full flush position.

Referring next to FIGS. 3A-3D, shown is one example of a dual flush handle assembly 600 according to various embodiments of the present disclosure. The dual flush handle assembly 600 may be used to initiate a partial flush and/or a full flush of a toilet. To this end, the dual flush handle assembly 600 may be in communication with, for example, the actuation control box 113 (FIG. 1), the activation assembly 106 (FIG. 1), or other dual flush activation control mechanisms. As further non-limiting examples, the dual flush handle assembly 600 may be used with various embodiments disclosed in co-pending U.S. patent application entitled "Dual Flush Activation" filed on Jan. 7, 2011 and assigned application Ser. No. 12/986,729, which is incorporated by reference herein in its entirety.

Figure 3A:
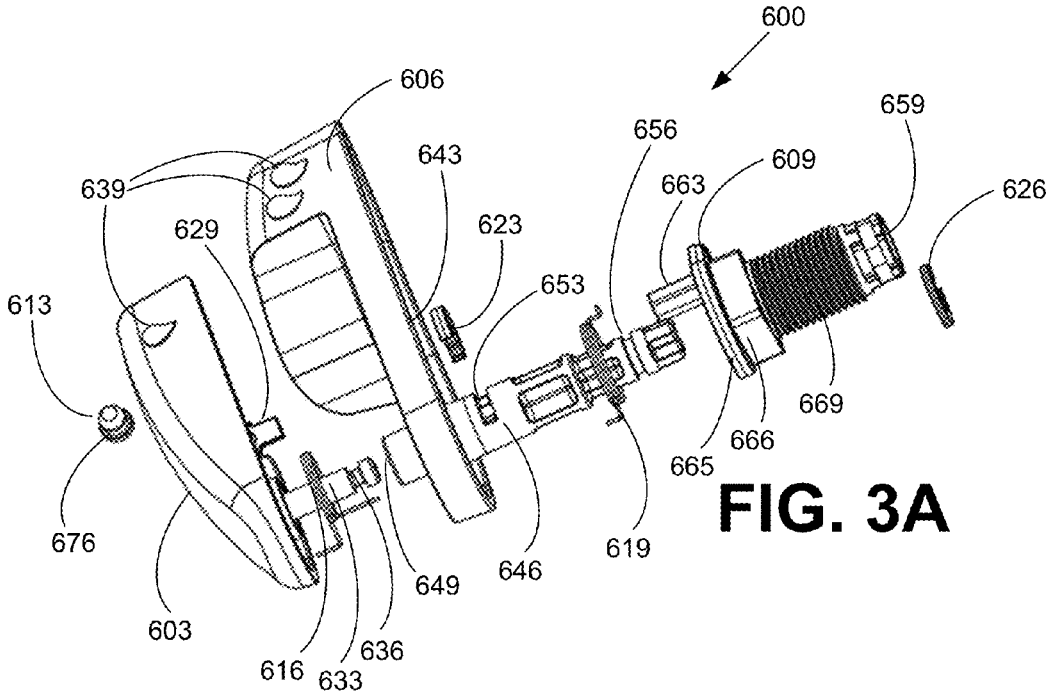
FIGS. 3A-3D are drawings that provide various views of an example of a dual flush handle assembly that can be utilized in the activation assembly of FIGS. 2A-2C in accordance with various embodiments of the disclosure.
Figure 3B:
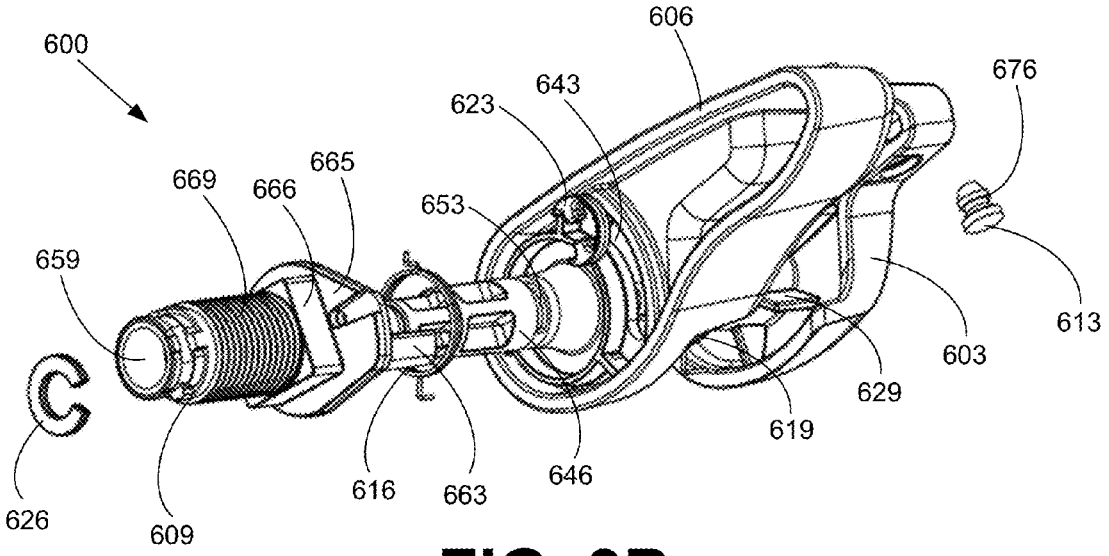

FIGS. 3A-3B show exploded views of one embodiment, among others, of the dual flush handle assembly 600. The dual flush handle assembly 600 includes a first handle lever 603, a second handle lever 606, a bushing 609, a damper 613, a first spring 616, a second spring 619, a first retaining element 623, a second retaining element 626, and possibly other components not discussed in detail herein.

The first handle lever 603 is shaped to be nested within the second handle lever 606. In this sense, the first handle lever 603 and second handle lever 606 are formed to facilitate at least a portion of the first handle lever 603 "fitting" within a portion of the second handle lever 606. The second handle lever 606 may fit within a profile of the first handle so as to promote the appearance of a single handle. Accordingly, the dual flush handle assembly 600 may present an appearance of a conventional toilet flush lever, while providing the functionality of a dual flush handle control.

As will later be described, the first handle lever 603 and second handle lever 606 may be configured to rotate coaxially about a common axis in order to initiate a partial flush and/or a full flush of a toilet. The first handle lever 603 may be limited in rotation by a certain amount. The second handle lever 606 may be limited in rotation by an amount that differs from the rotation of the first handle lever 603. In this sense, the rotation of the first handle lever 603 and rotation of the second handle lever 606 may overlap at least partially. Further, it is emphasized that initiating a partial flush or a full flush may be caused by rotating the first handle lever 603 or second handle lever 606, respectively, in the same direction of rotation.

The first handle lever 603 is configured to rotate about an axis by a predetermined angle of rotation. To this end, the first handle lever 603 includes a projection 629 and post 633, both extending from a toilet-facing surface of the first handle lever 603. In various embodiments, the projection 629 may comprise tabs, pins, knobs, detents, or other types of projections. The post 633 includes a post groove 636 to facilitate retaining the first handle lever 603 to the dual flush handle assembly 600 as will be later described. The first handle lever 603 may also include one or more indicators 639 to denote to a user that the function of the first handle lever 603 is to initiate a partial flush of a toilet.

The second handle lever 606 is also configured to rotate about an axis by a predetermined angle of rotation. It is emphasized that the second handle lever 606 may rotate by a predetermined angle of rotation that is different than the angle of rotation of the first handle lever 603. The second handle lever 606 includes a slot 643, a stem 646, one or more indicators 639, and possibly other features not discussed in detail herein.

Figure 3C:
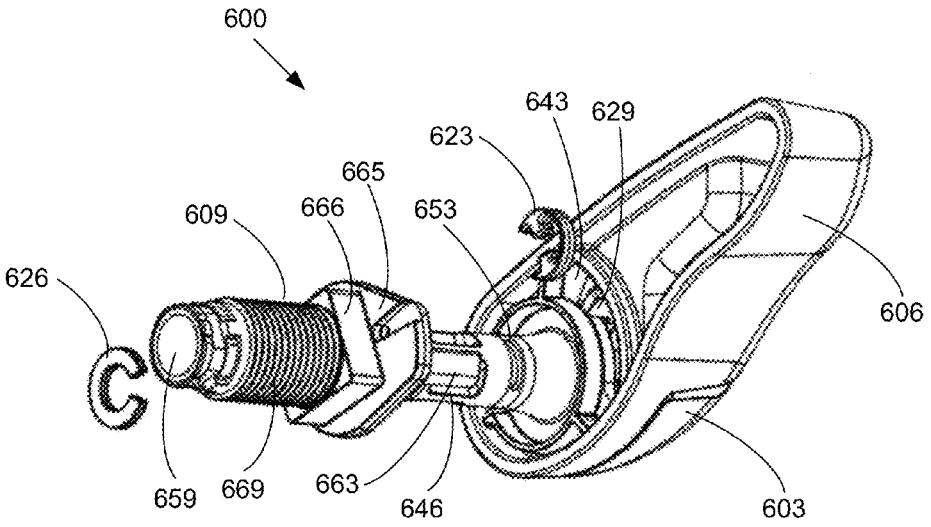
Figure 3D:
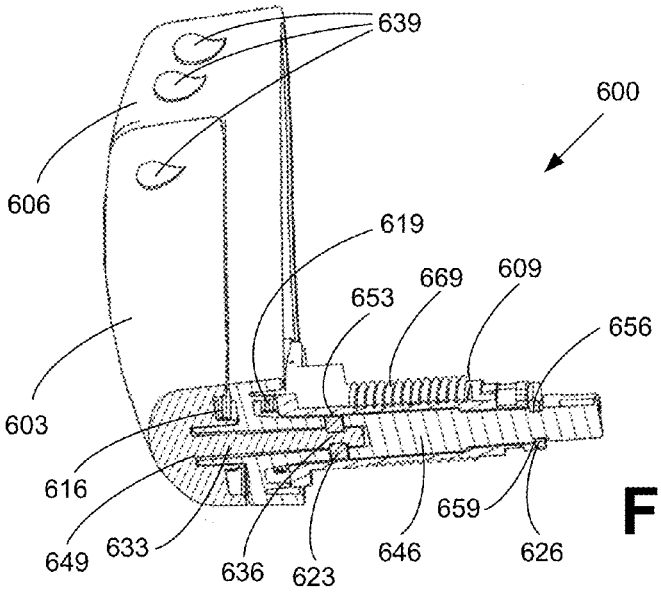

As best shown in FIGS. 3B and 3C, the slot 643 is disposed in a wall of the second handle lever 606 and is configured to receive the projection 629. The stem 646 extends from both the outward and toilet-facing surfaces of the second handle lever 606. In alternative embodiments, the stem 646 may extend from only one of the outward or toilet-facing surfaces of the second handle lever 606.

The stem 646 includes a bore 649 extending from the outward end of the stem 646. The bore 649 is configured to receive the post 633 of the first handle lever 603. Although the stem 646 shown in FIGS. 3A-3D is configured to receive the post 633, the post 633 in alternative embodiments may be configured to receive the stem 646.

The portion of the stem 646 extending from the interior end of the second handle lever 606 includes a stem slot 653 configured to accommodate the first retaining element 623. At the distal end of the interior portion of the stem 646 is a stem groove 656. The stem groove 656 is configured to receive the second retaining element 626 and facilitates securing the second handle lever 606 to the bushing 609. The distal end of the stem 646 can be configured to detachably engage a cam of the actuation control box 113 (FIGS. 2A-2C). The distal end of the bushing 609 may also be configured to detachably connect to the actuation control box 113 (FIG. 1). For example, the end of the bushing 609 can engage with the actuation control box 113 by a spring-loaded clip assembly.

The bushing 609 is configured to extend through an opening in a wall of a toilet tank. The bushing 609 includes a passage 659, a stop 663, a lip 665, a rectangular segment 666, a threaded segment 669, and possibly other features not discussed in detail herein.

The passage 659 extends longitudinally through the bushing 609 and is configured for the stem 646 of the second handle lever 606 to pass at least partially through the bushing 609. The stop 663 extends from the bushing 609 and is configured to extend through the slot 643 of the second handle lever 606 and to abut the projection 629 of the first handle lever 603 as will be later described.

The lip 665 of the bushing 609 is configured to abut an exterior surface of a toilet tank. The rectangular segment 666 is configured to be secured in a rectangular opening in the toilet tank wall, thereby preventing rotational movement of the bushing 609 with respect to the toilet tank wall. The threaded segment 669 of the bushing 609 is configured to receive an appropriately threaded nut that abuts an interior surface of the toilet tank wall, thereby preventing translational movement of the bushing 609 with respect to the toilet tank.

The damper 613 may be disposed between the first handle lever 603 and second handle lever 606. In the embodiment shown in FIGS. 3A-3D, the damper 613 is attached to the first handle lever 603. However, in alternative embodiments, the damper 613 may be attached to the second handle lever 606. Best shown in FIG. 3B, the damper includes a lip 676 to facilitate retaining the damper 613 in an appropriate aperture of the first handle lever 603. In alternative embodiments, the damper 613 may be attached using, for example, an adhesive or other attachment mechanism.

The damper 613 may be formed of various cushioning materials, such as rubber, nylon, foam, or other materials. By being disposed between the first handle lever 603 and second handle lever 606, the damper 613 may prevent or reduce sound caused by the first handle lever 603 abruptly contacting the second handle lever 606. Additionally, the damper 613 may provide a cushioned sensation when using dual flush handle assembly 600.

The first spring 616 may be configured to provide a bias force that retains the first handle lever 603 towards the second handle lever 606 when in a neutral position. To this end, the first spring 616 may be disposed between the first handle lever 603 and second handle lever 606, with the first spring 616 being around the post 633. The ends of the first spring 616 may be retained, for example, in appropriate openings in the first handle lever 603 and/or second handle lever 606 as is appreciated.

In other embodiments, the function of the first spring 616 may be incorporated into the damper 613. To this end, the damper 613 may be formed of a spring-like material and attached to the first handle lever 603 and second handle lever 606.

The second spring 619 is configured to provide a bias force that facilitates returning the second handle lever 606 and/or first handle lever 603 to a neutral position after initiating a flush. To this end, the second spring 619 may be disposed between the second handle lever 606 and bushing 609, with the second spring 619 being around the stem 646 of the second handle lever 606. The ends of the second spring 619 may be retained, for example, in appropriate holes in the second handle lever 606 and/or bushing 609.

The second spring 619 may also facilitate installation of the dual flush handle assembly 600. In this sense, the second spring 619 may bias the first handle lever 603 and second handle lever 606 to be in an approximately horizontal position when the bushing 609 is inserted into an opening in the toilet tank wall and prevented from rotating with respect to the tank wall. In other words, with the bushing 609 inserted into the tank wall and fixed from rotating, the second spring 619 may facilitate the first handle lever 603 and second handle lever 606 being biased in an approximately horizontal position.

Although the first spring 616 and second spring 619 are shown as being coil springs, other types of springs may be used in accordance with the present disclosure. For example, flat springs, leaf spring, rubber bands, or any other type of spring element may be used. Further, it is understood that a first spring 616 and/or second spring 619 may be omitted in various embodiments.

The first retaining element 623 is configured to retain the post 633 within the stem 646. To this end, the first retaining element 623 may insert at least partially into the stem slot 653 and clip to the post groove 636. Thus, the first retaining element 623 may retain the first handle lever 603 to the second handle lever 606 in a lateral position, while facilitating rotation of the first handle lever 603 with respect to the second handle lever 606.

In a similar fashion, the second retaining element 626 is configured to retain the stem 646 within the bushing 609. To this end, with the stem groove 656 extending through the passage 659 of the bushing 609, the second retaining element 626 may clip to the stem groove 656. Thus, the second retaining element 626 may retain the second handle lever 606 to the bushing 609 in a lateral position, while facilitating rotation of the second handle lever 606 and/or first handle lever 603 with respect to the bushing 609.

It is understood that other methods of retaining the first handle lever 603, second handle lever 606, and bushing 609 may be used. For example, instead of the stem 646 extending from the second handle lever 606, the stem 646 may extend from the bushing 609. In such a case, the second handle lever 606 and/or first handle lever 603 may include appropriate mechanisms for attachment as can be appreciated.

In addition, it is understood that other mechanisms of restricting the rotation of the first handle lever 603 and/or second handle lever 606 may be used. For example, although embodiment of FIGS. 3A-3D shows the first handle lever 603 comprising the projection 629 and the second handle lever 606 comprising the slot 643, the second handle lever 606 may comprise a projection 629 in various alternative embodiments. Additionally, the projection 629 may extend from the bushing 609 in various other embodiments. Even further, the first handle lever 603 and/or bushing 609 may comprise the slot 643.

Next, a description of the general operation of the dual flush handle assembly 600 is provided. FIGS. 4A-4C, 5A-5C, and 6A-6C show progressions of the dual flush handle assembly 600 being in a neutral position, initiating a partial flush (i.e., "quick flush"), and initiating a full flush, respectively.

Figure 4A:
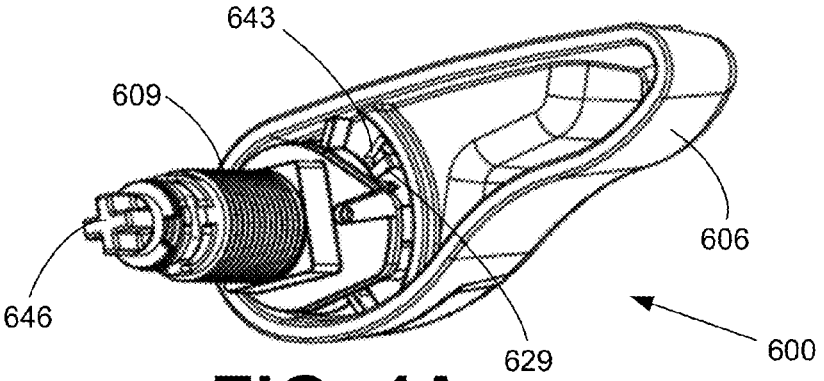
FIGS. 4A-4C are drawings that provide various views of the dual flush handle assembly of FIGS. 3A-3D in a neutral position in accordance with various embodiments of the disclosure.
Figure 4B:
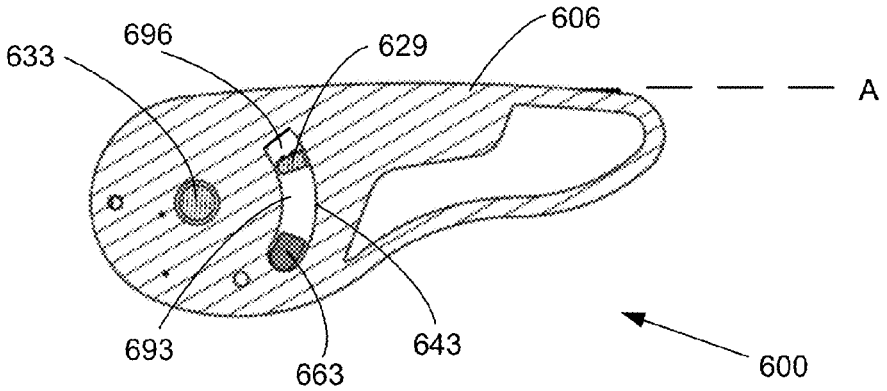
Figure 4C:
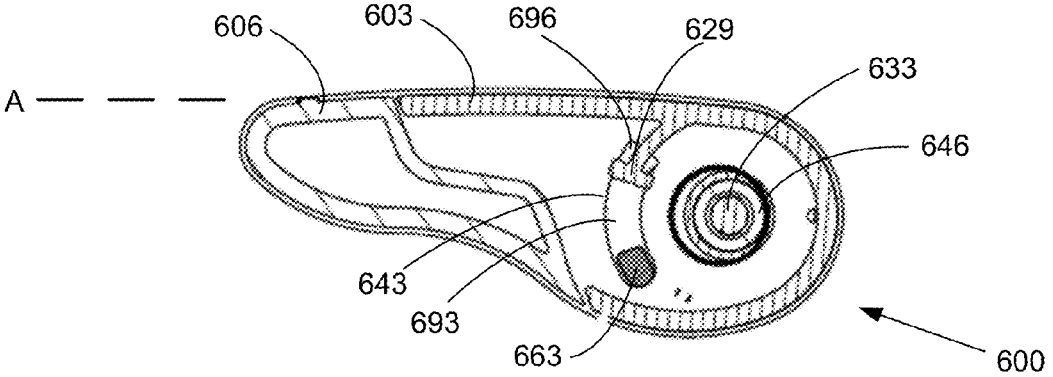

With reference to FIGS. 4A-4C, shown is the dual flush handle assembly 600 in a neutral position according to various embodiments of the present disclosure. The neutral position shown is the position to which the dual flush handle assembly 600 returns after a flush has been initiated. As shown in FIGS. 4B and 4C, the reference line A denotes the position at which a portion of the first handle lever 603 and second handle lever 606 rest while in the neutral position.

As shown in FIGS. 4A-4C, the projection 629 of the first handle lever 603 (FIGS. 3A-3D) is positioned within the slot 643 of the second handle lever 606. Also, the stop 663 of the bushing 609 is positioned within the slot 643 of the second handle lever 606. As best shown in FIGS. 4B and 4C, there is a space 693 between the stop 663 and the projection 629. Further, there is a space 696 between the projection 629 and an edge of the slot 643. Additionally, the stop 663 of the bushing 609 is engaged with the opposite edge of the slot 643.

Figure 5A:
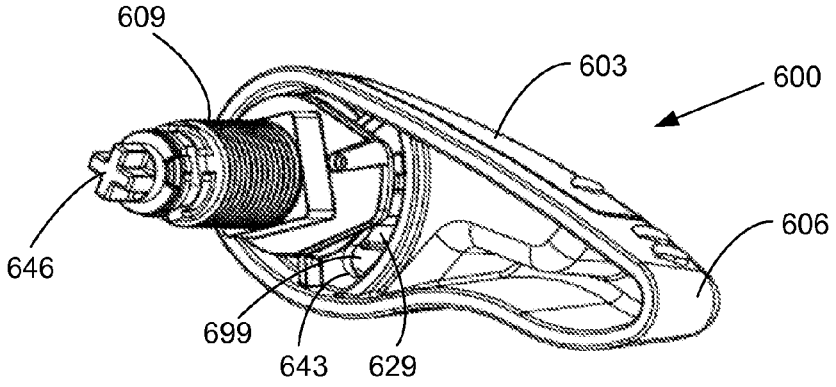
FIGS. 5A-5C are drawings that provide various views of the dual flush handle assembly of FIGS. 3A-3D in a position configured to initiate a partial flush in a toilet in accordance with various embodiments of the disclosure.
Figure 5B:
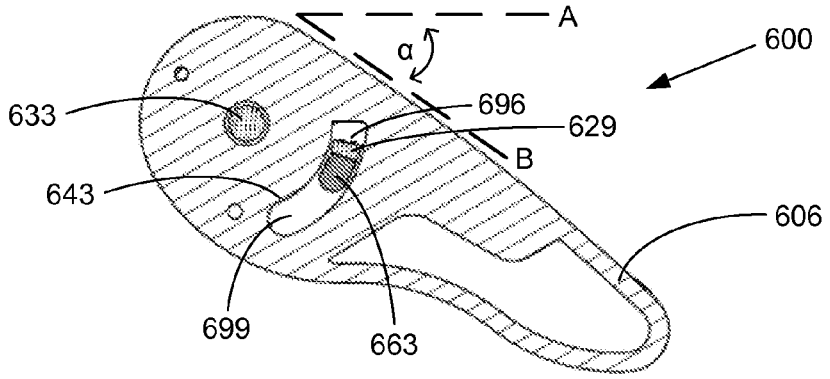
Figure 5C:
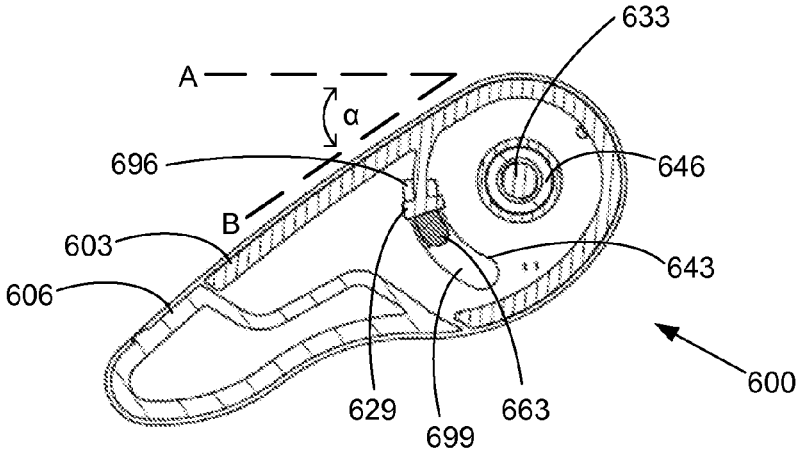

Turning now to FIGS. 5A-5C, shown is the dual flush handle assembly 600 in a position configured to initiate a partial flush of a toilet. The dual flush handle assembly 600 may arrive in this position, for example, by a user pressing on the first handle lever 603. Rotating the first handle lever 603 pushes against the second handle lever 606 causing the second handle lever 606, and thus the stem 646, to rotate as well. The rotation of the first handle lever 603 is limited by the projection 629 of the first handle lever 603 making contact with the stop 663 of the bushing 609. By rotating the first handle lever 603 by the predetermined amount, the stem 646 rotates to initiate a partial flush, for example, through the actuation control box 113 (FIG. 1) as described above.

As shown in FIGS. 5B and 5C, the angle $\alpha$ denotes the angle of rotation that the first handle lever 603 and second handle lever 606 have rotated from the neutral position (denoted by reference line A) to the position for initiating a partial flush (denoted by reference line B). By rotating by the angle $\alpha$, the stop 663 now abuts the projection 629 of the first handle lever 603. Thus, the angle of rotation a is limited by the projection 629 engaging the stop 663. With the projection 629 engaging the stop 663, there is a space 699 between the stop 663 and an edge of the slot 643. Additionally, the space 696 between the projection 629 and opposite end of the slot 643 still exists.

After a partial flush has been initiated, the dual flush handle assembly 600 may automatically return to the neutral position shown in FIGS. 4A-4C. To this, end, the second spring 619 or any other mechanism may cause the dual flush handle assembly 600 to return to the neutral position.

Figure 6A:
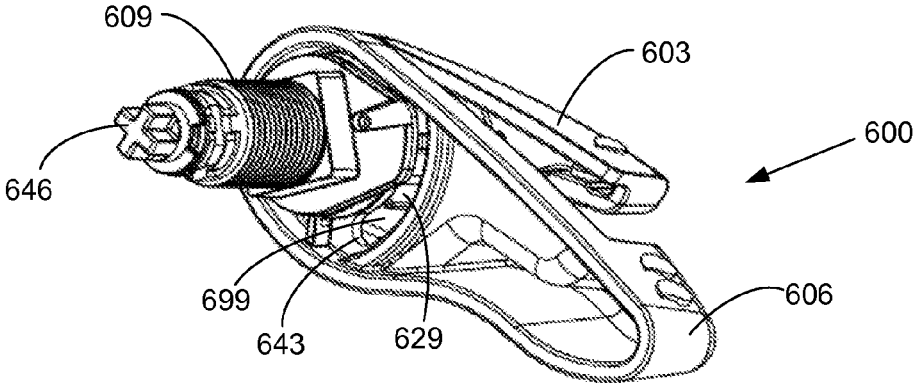
FIGS. 6A-6C are drawings that provide various views of the dual flush handle assembly of FIGS. 3A-3D in a position configured to initiate a full flush in a toilet in accordance with various embodiments of the disclosure.
Figure 6B:
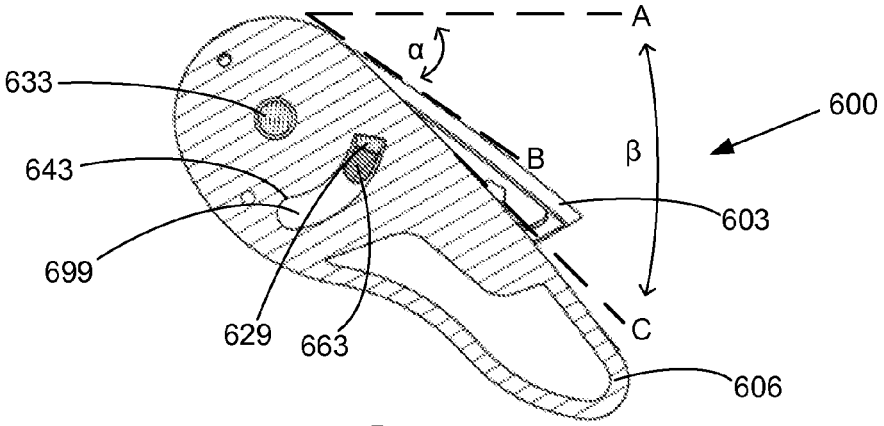
Figure 6C:
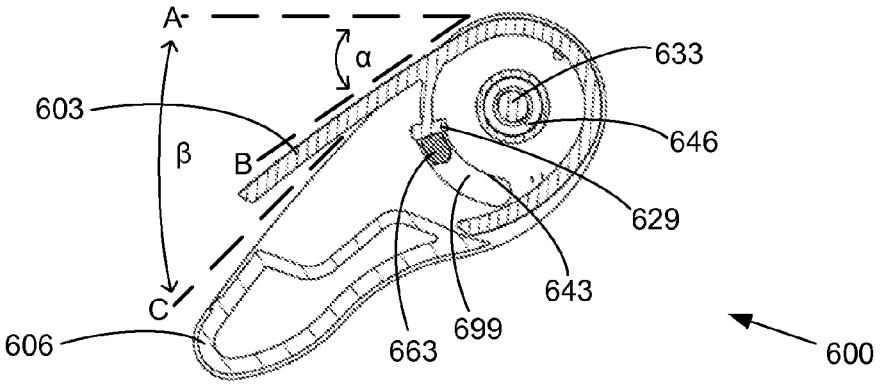

Turning to FIGS. 6A-6C, shown is the dual flush handle assembly 600 in a position configured to initiate a full flush of a toilet. The dual flush handle assembly 600 may arrive in this position, for example, by a user pressing the second handle lever 606. By pressing on the second handle lever 606, the first spring 616 (FIGS. 3A-3D) cause the first handle lever 603 to rotate in conjunction with the second handle lever 606 by angle $\alpha$ until the projection 629 of the first handle lever 603 contacts the stop 663 of the bushing 609. While the first handle lever 603 stops rotating at angle $\alpha$, the second handle lever 606 may continue to rotate until the edge of the slot 643 of the second handle lever 606 contacts the tab of the first handle lever 603. Thus, the stem 646 may rotate to initiate a full flush of a toilet, for example, via the actuation control box 113 (FIG. 1).

As shown in FIGS. 6B and 6C, the angle $\alpha$ denotes the angle of rotation that the first handle lever 603 has rotated from the neutral position (denoted by reference line A). Similarly, the angle $\beta$ shows the angle of rotation that the second handle lever 606 has rotated from the neutral position (denoted by reference line A) to the full flush position (denoted by reference line C).

As best shown in FIGS. 6B and 6C, the stop 663 abuts the projection 629, and the projection 629 engages the edge of the slot 643 of the second handle lever 606. Thus, the slot 643 in conjunction with the projection 629 acts to define the predetermined angle $\beta$ of rotation. With the dual flush handle assembly 600 in the position configured to initiate a full flush, the space 696 (FIG. 5A-5C) between the projection 629 and edge of the slot 643 no longer exists. Additionally, the space 699 between the stop 663 and opposite edge of the slot 643 has widened.

After a full flush has been initiated, the dual flush handle assembly 600 may automatically return to the neutral position shown in FIGS. 4A-4C. To this end, the second spring 619 or any other mechanism may return the dual flush handle assembly 600 to the neutral position. In alternative embodiments, the dual flush handle assembly 600 may return to the neutral position using other mechanisms. As non-limiting examples, the dual flush handle assembly 600 may return to the neutral position due its own weight, from a flush valve dropping due to a drop in water level in the toilet tank, from a spring force inside the activation control box 113 (FIG. 1), from a spring force associated with a flush valve, or from any other mechanism.

Figure 7A:
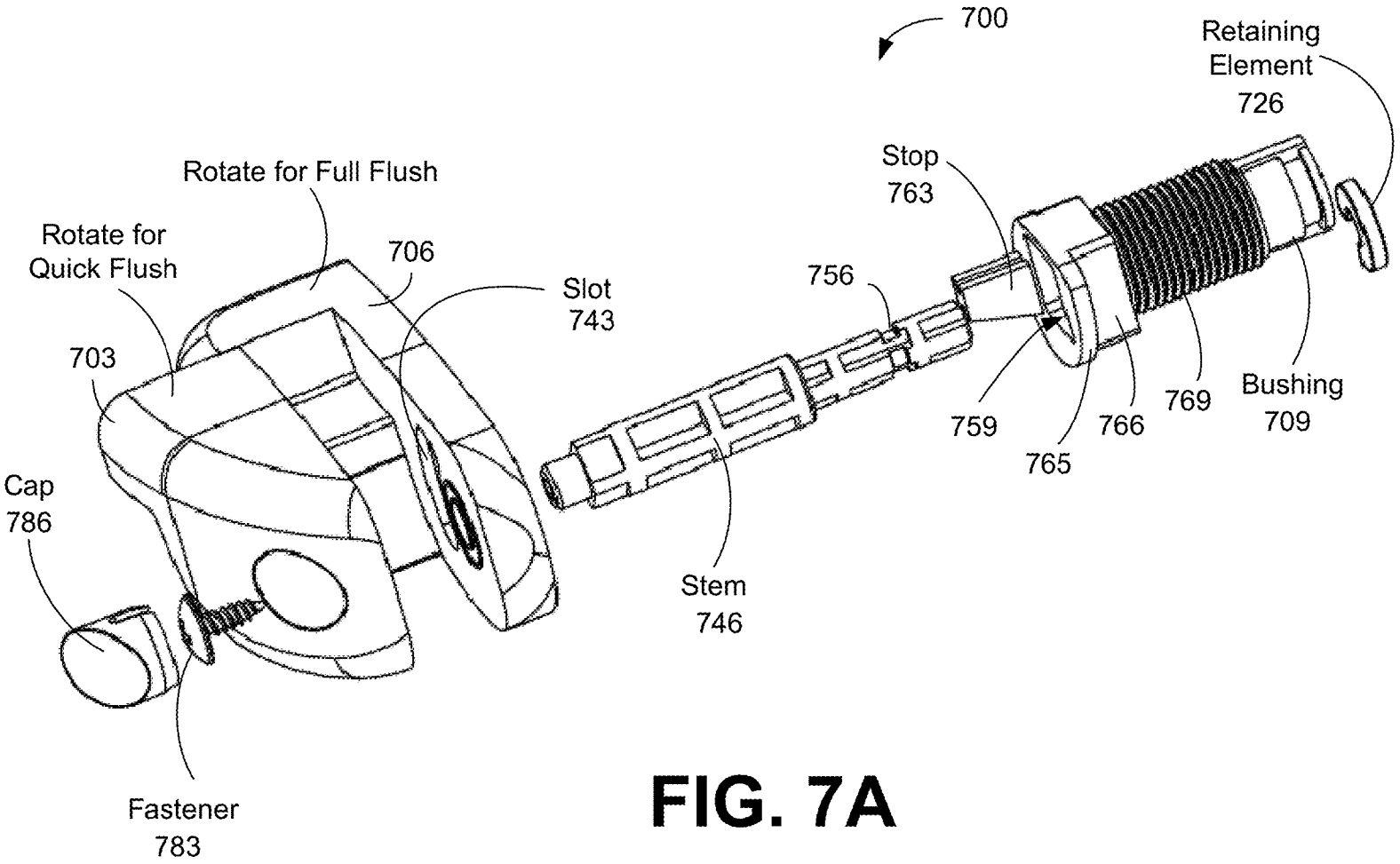
FIGS. 7A-7F, 8A-8C, 9A-9C, 10A-10B, 11A-11E, 12A-12E, 13A-13F, and 14A-14D are drawings that provide various views of examples of dual flush handle assemblies that can be utilized in the activation assembly of FIGS. 2A-2C in accordance with various embodiments of the disclosure.
Figure 7B:
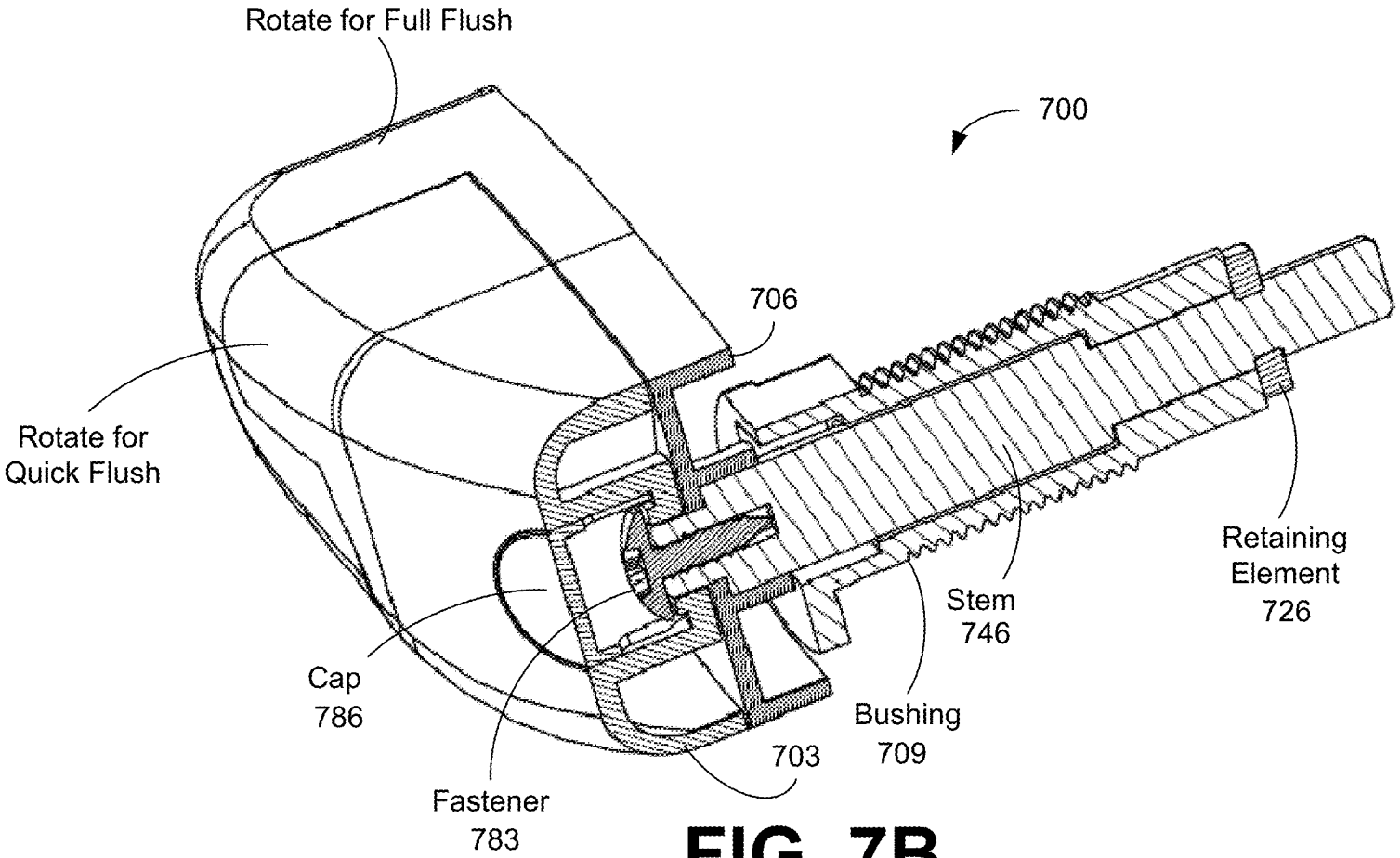
Figure 7C:
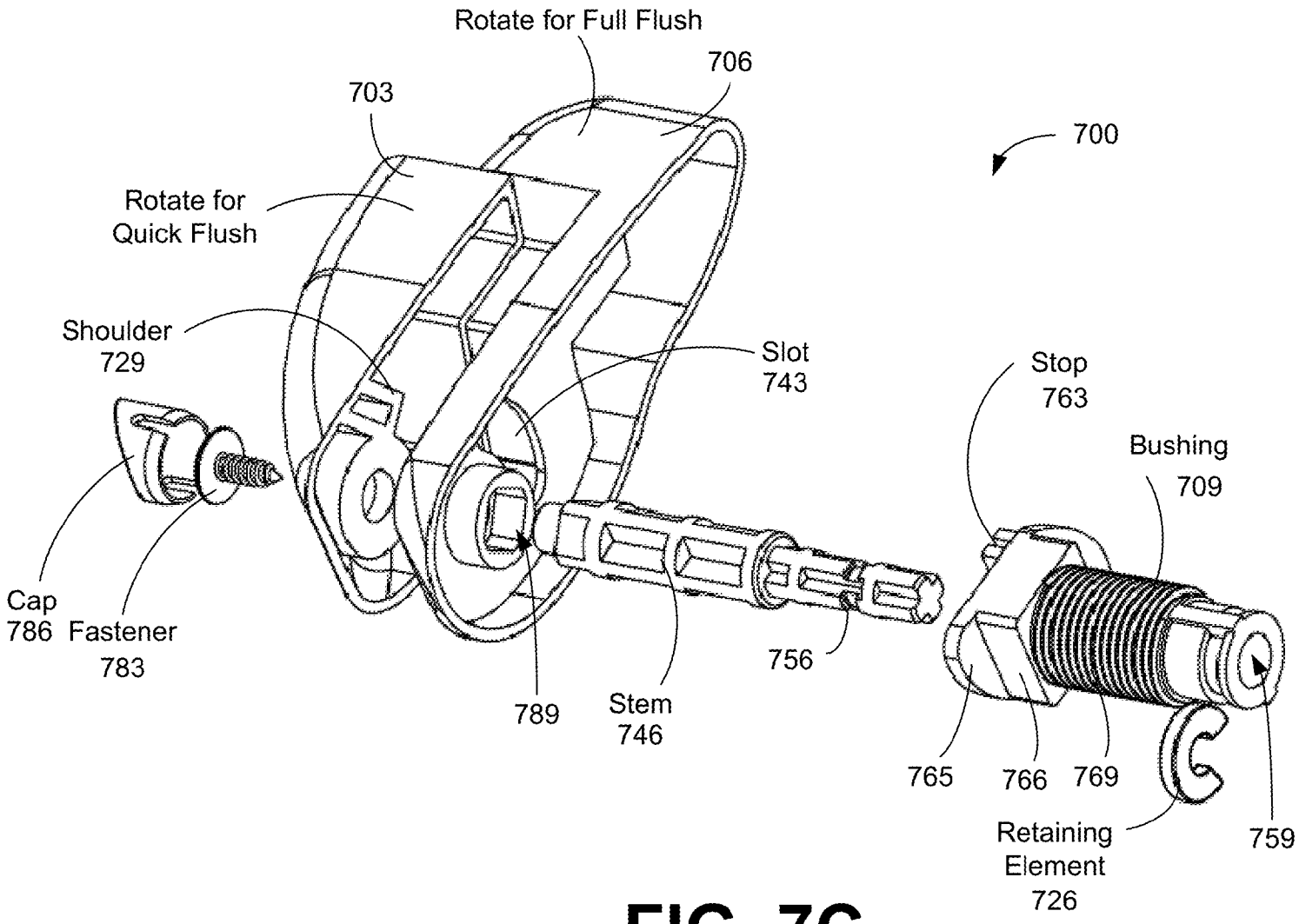

Referring next to FIGS. 7A-7F, shown is another example of a dual flush handle assembly 700. The dual flush handle assembly 700 may be used to initiate a partial flush and/or a full flush of a toilet. To this end, the dual flush handle assembly 700 may be in communication with, for example, the actuation control box 113 (FIG. 1). FIGS. 7A and 7C show exploded views of the dual flush handle assembly 700. The dual flush handle assembly 700 includes a first handle lever 703, a second handle lever 706, a bushing 709, and other components such as, e.g., springs, retaining elements, and/or damper as discussed with respect to the dual flush handle assembly 600 of FIGS. 3A-3D.

The first handle lever 703 is shaped to be nested within the second handle lever 706. In this sense, the first handle lever 703 and second handle lever 706 are formed to facilitate at least a portion of the first handle lever 703 "fitting" within a portion of the second handle lever 706. The second handle lever 706 may fit within a profile of the first handle 703 so as to promote the appearance of a single handle. Accordingly, the dual flush handle assembly 700 may present an appearance of a conventional toilet flush lever, while providing the functionality of a dual flush handle control.

The first handle lever 703 is configured to rotate about an axis by a predetermined angle of rotation. To this end, the first handle lever 703 includes a shoulder 729 accessible from a toilet-facing side or surface of the first handle lever 703. The shoulder 729 limits the rotation of the first handle lever 703. The second handle lever 706 is also configured to rotate about an axis by a predetermined angle of rotation. It is emphasized that the second handle lever 706 may rotate by a predetermined angle of rotation that is different than the angle of rotation of the first handle lever 703. The second handle lever 706 includes a slot 743, which provides access to the shoulder 729 of the first handle lever 703 through the second handle lever 706.

A stem 746 is detachably attached to the second handle lever 706 to extend outward from the toilet-facing side or surface of the second handle lever 706. For example, the stem 746 may be secured to the second handle lever 706 by a fastener 783 (e.g., a screw) that extends through the first and second handle levers 703 and 706 as illustrated in the cutaway view of FIG. 7B. A shaped or keyed slot 789 (FIG. 7C) allows torque to be applied to the stem 746 via the second handle lever 706. A force applied to the first handle lever 703 is transferred through the second handle lever 706 to the stem 746. A cap 786 may be inserted into a recess of the first handle lever to cover the fastener 783.

A bushing 709 is configured to extend through an opening in a wall of a toilet tank. The bushing 709 includes a passage 759, a stop 763, a lip 765, a rectangular segment 766, a threaded segment 769, and possibly other features not discussed in detail herein. The passage 759 extends longitudinally through the bushing 709 and is configured for the stem 746 to pass at least partially through the bushing 709. The stop 763 extends from the bushing 709 and is configured to extend through the slot 743 of the second handle lever 706 and to abut the shoulder 729 of the first handle lever 703 as will be later described. The distal end of the bushing 709 may also be configured to detachably connect to the actuation control box 113 (FIG. 1).

The portion of the stem 746 extending from the second handle lever 706 includes a stem groove 756 at the distal end. The stem groove 756 is configured to receive a retaining element 726 to facilitate securing the first and second handle levers 703/706 to the bushing 709. To this end, with the stem groove 756 extending through the passage 759 of the bushing 709, the retaining element 726 may clip to the stem groove 756 to retain the stem 746 within the bushing 709. Thus, the retaining element 726 may retain the second handle lever 706 to the bushing 709 in a lateral position, while facilitating rotation of the second handle lever 706 and/or first handle lever 703 with respect to the bushing 709. The distal end of the stem 746 can be configured to detachably engage a cam of the actuation control box 113 (FIGS. 2A-2C).

The lip 765 of the bushing 709 is configured to abut an exterior surface of a toilet tank. The rectangular segment 766 is configured to be secured in a corresponding opening in the toilet tank wall, thereby preventing rotational movement of the bushing 709 with respect to the toilet tank wall. The threaded segment 769 of the bushing 709 is configured to receive an appropriately threaded nut that abuts an interior surface of the toilet tank wall, thereby preventing translational movement of the bushing 709 with respect to the toilet tank.

Figure 7D:
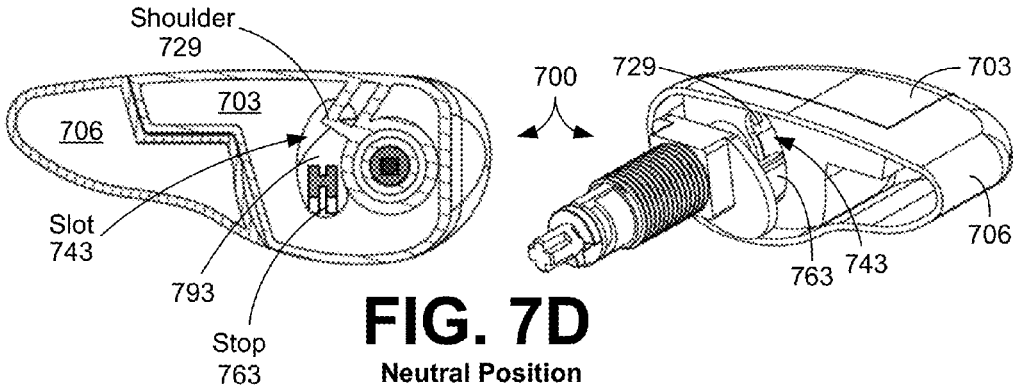
Figure 7E:
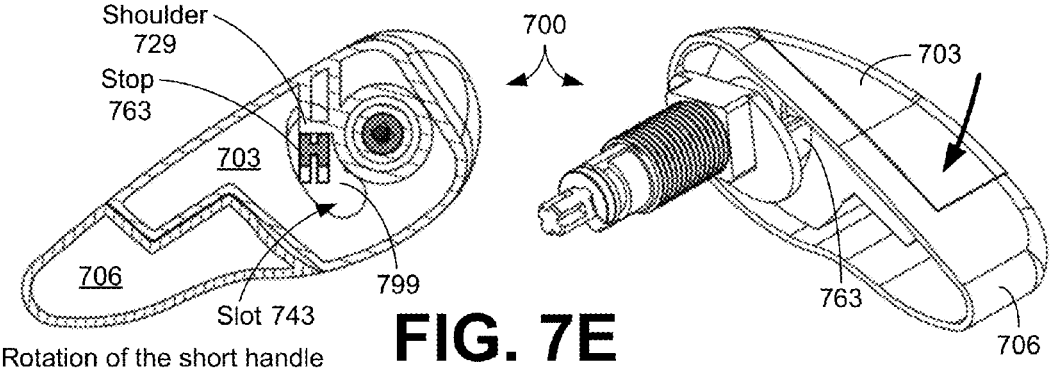
Figure 7F:
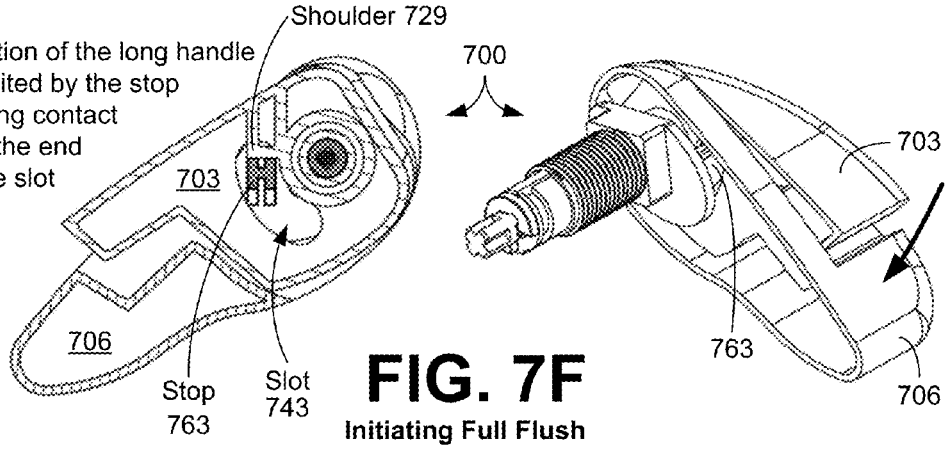

Next, a description of the general operation of the dual flush handle assembly 700 is provided. FIGS. 7D, 7E, and 7F show progressions of the dual flush handle assembly 700 being in a neutral position, initiating a partial (or "quick") flush, and initiating a full flush, respectively.

With reference to FIG. 7D, shown is the dual flush handle assembly 700 in a neutral position according to various embodiments of the present disclosure. The neutral position shown is the position to which the dual flush handle assembly 700 returns after a flush has been initiated. As shown in FIG. 7D, the shoulder 729 of the first handle lever 703 is positioned adjacent to the slot 743 of the second handle lever 706. Also, the stop 763 of the bushing 709 extends through the slot 743 of the second handle lever 706. As best shown in the cut-away view of FIG. 7D, there is a space 793 between the stop 763 and the shoulder 729. Further, when the dual flush handle assembly 700 is in the neutral position the shoulder 729 is located below an upper edge of the slot 743. Additionally, the stop 763 of the bushing 709 is engaged with the lower edge of the slot 743.

Turning now to FIG. 7E, shown is the dual flush handle assembly 700 in a position configured to initiate a partial (or "quick") flush of a toilet. The dual flush handle assembly 700 may arrive in this position, for example, by a user pressing on the first handle lever 703 as indicated by the arrow. Rotating the first handle lever 703 pushes against the second handle lever 706 causing the second handle lever 706, and thus the stem 746, to rotate and disengage with the lower edge of the slot 743. The rotation of the first handle lever 703 is limited by the shoulder 729 of the first handle lever 703 making contact with the stop 763 of the bushing 709. By rotating the first handle lever 703 by the amount limited by the shoulder 729 and stop 763, the stem 746 rotates a predetermined amount to initiate a partial flush, for example, through the actuation control box 113 (FIG. 1) as described above.

After a partial flush has been initiated, the dual flush handle assembly 700 may automatically return to the neutral position shown in FIG. 7D. To this, end, a spring or other appropriate mechanism may cause the dual flush handle assembly 700 to return to the neutral position.

Turning to FIG. 7F, shown is the dual flush handle assembly 700 in a position configured to initiate a full flush of a toilet. The dual flush handle assembly 700 may arrive in this position, for example, by a user pressing the second handle lever 706 as indicated by the arrow. By pressing on the second handle lever 706, the first handle lever 703 rotates until the shoulder 729 of the first handle lever 703 contacts the stop 763 of the bushing 709. While the first handle lever 703 stops rotating when the shoulder 729 engages with the stop 763, the second handle lever 706 may continue to rotate until the upper edge of the slot 743 of the second handle lever 706 contacts the stop 763 of the bushing 709. Thus, the stem 746 may rotate to initiate a full flush of a toilet, for example, via the actuation control box 113 (FIG. 1).

As best shown in cut-away view of FIG. 7F, the stop 763 engages with the upper edge of the slot 743 of the second handle lever 706. Thus, the slot 743 in conjunction with the stop 763 acts to define the predetermined angle of rotation. With the dual flush handle assembly 700 in the position configured to initiate a full flush, the space 799 between the stop 763 and the lower edge of the slot 743 has widened.

After a full flush has been initiated, the dual flush handle assembly 700 may automatically return to the neutral position shown in FIG. 7D. To this end, a spring or other appropriate mechanism may return the dual flush handle assembly 700 to the neutral position. In alternative embodiments, the dual flush handle assembly 700 may return to the neutral position using other mechanisms. As non-limiting examples, the dual flush handle assembly 700 may return to the neutral position due its own weight, from a flush valve dropping due to a drop in water level in the toilet tank, from a spring force inside the activation control box 113 (FIG. 1), from a spring force associated with a flush valve, or from any other mechanism.

Figure 8A:
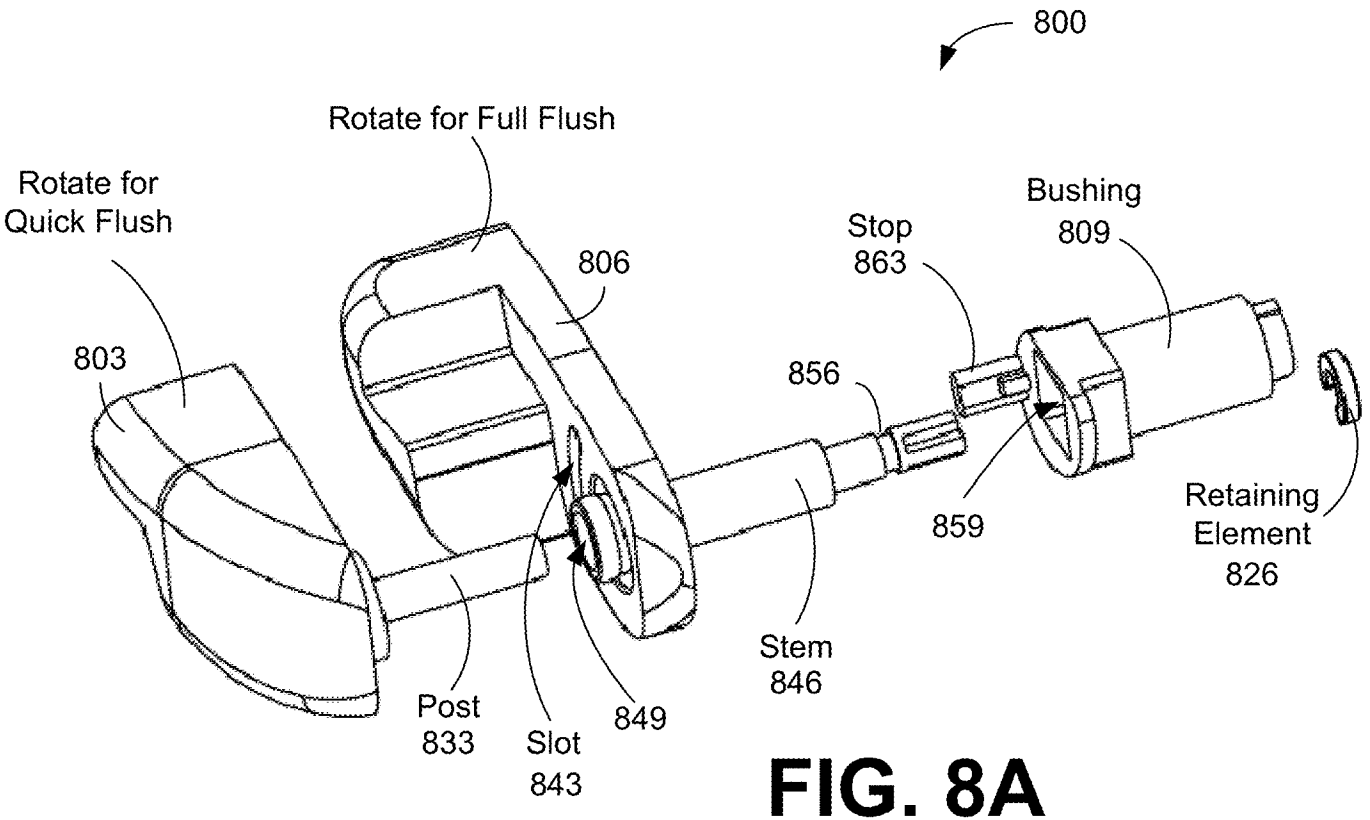
Figure 8B:
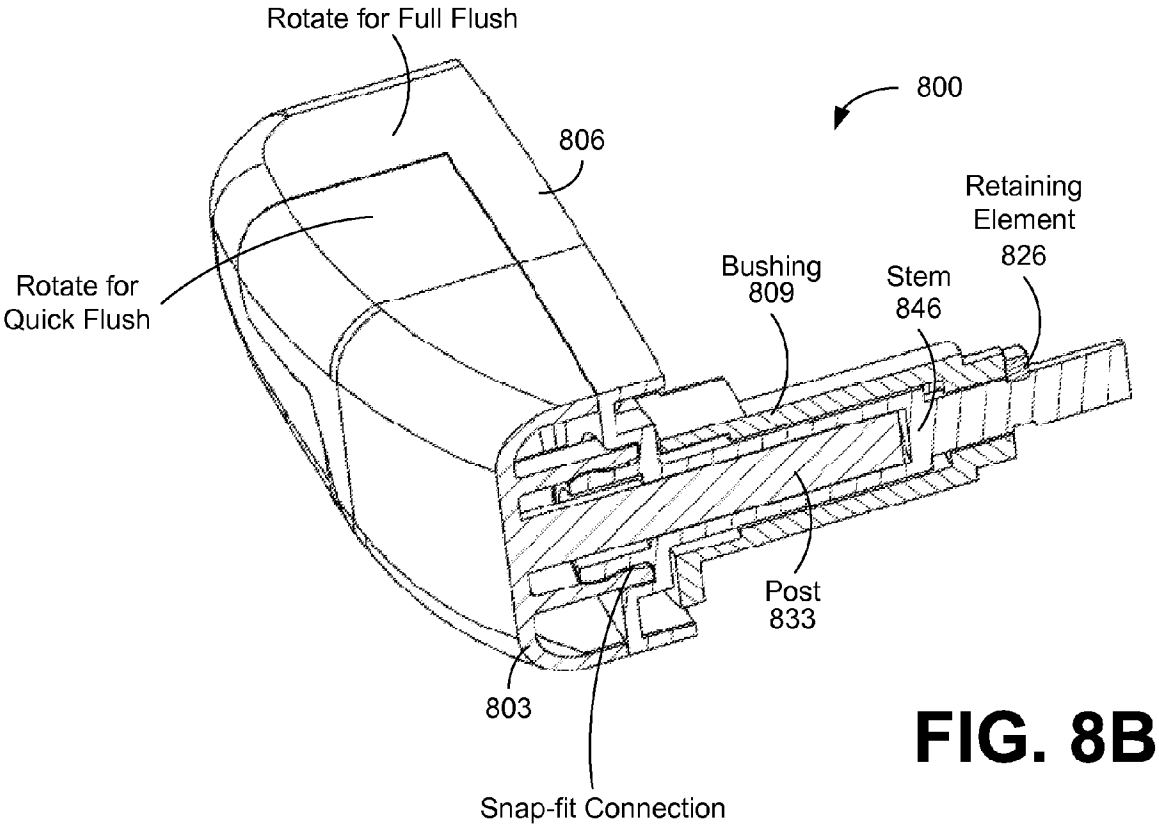
Figure 8C:
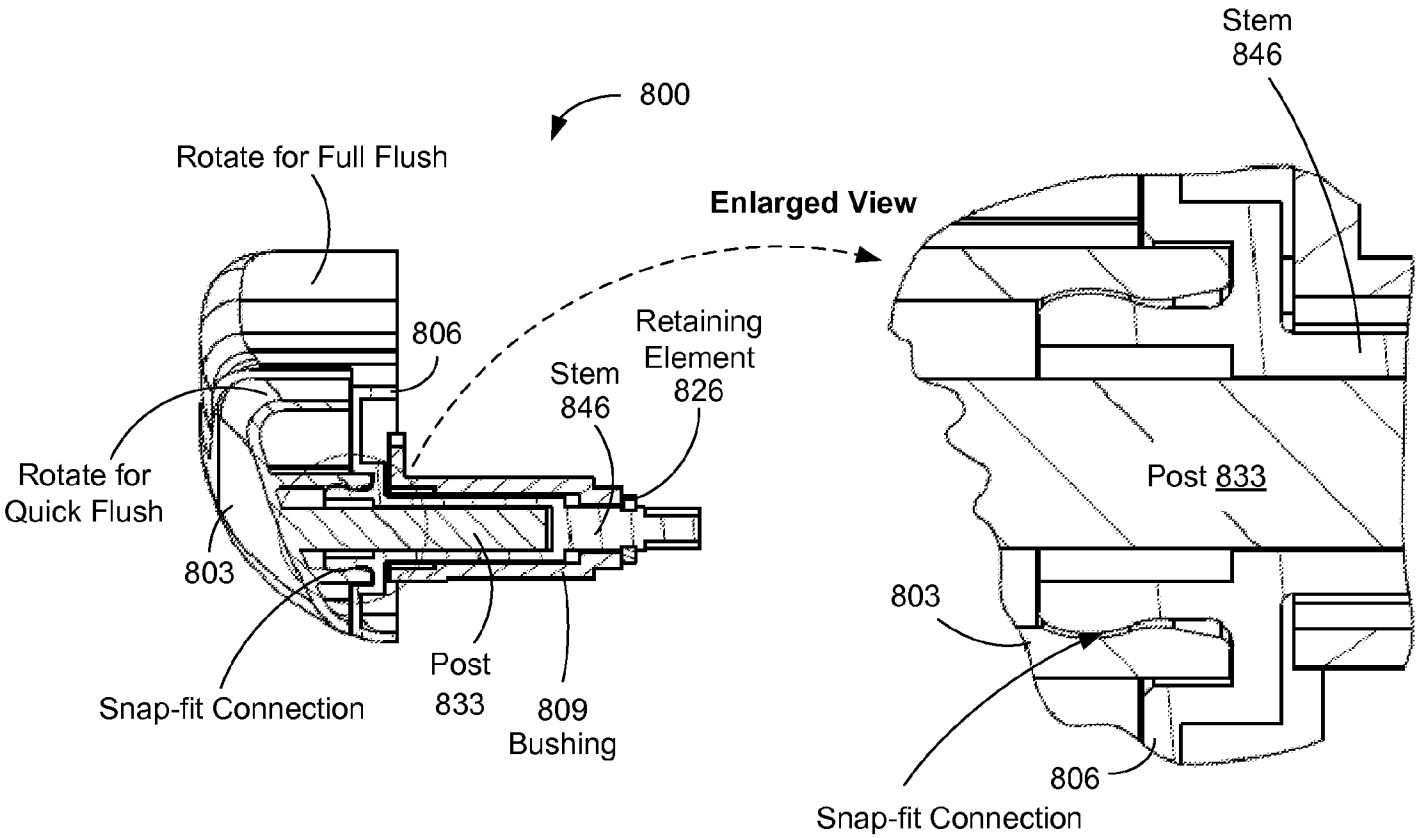

Referring next to FIGS. 8A-8C, shown is another example of a dual flush handle assembly 800 that may be used to initiate a partial flush and/or a full flush of a toilet. To this end, the dual flush handle assembly 800 may be in communication with, for example, the actuation control box 113 (FIG. 1). FIG. 8A shows an exploded view of the dual flush handle assembly 800. The dual flush handle assembly 800 includes a first handle lever 803, a second handle lever 806, a bushing 809, and other components such as, e.g., springs, retaining elements, and/or damper as discussed with respect to the dual flush handle assembly 600 of FIGS. 3A-3D.

The first handle lever 803 is shaped to be nested within the second handle lever 806. The first handle lever 803 is configured to rotate about an axis by a predetermined angle of rotation. To this end, the first handle lever 803 includes a post 833 extending from a toilet-facing side or surface of the first handle lever 803. The first handle lever 803 also includes a shoulder (not shown) accessible from a toilet-facing side or surface of the first handle lever 803. As with the example of FIGS. 7A-7F, the shoulder limits the rotation of the first handle lever 803. The second handle lever 806 is also configured to rotate about an axis by a predetermined angle of rotation. The second handle lever 806 may rotate by a predetermined angle of rotation that is different than the angle of rotation of the first handle lever 803. The second handle lever 806 includes a slot 843, which provides access to the shoulder of the first handle lever 803 through the second handle lever 806.

A stem 846 may be integrally cast as part of the second handle lever 806 to extend from both the outward and toilet-facing sides or surfaces of the second handle lever 806. In alternative embodiments, the stem 646 may extend from only one of the outward or toilet-facing surfaces of the second handle lever 806. The stem 846 includes a bore 849 accessible from the outward end of the stem 846. The bore 849 is configured to receive the post 833 of the first handle lever 803. Although the stem 846 shown in FIGS. 8A-8C is configured to receive the post 833, in alternative embodiments the post 833 may include a bore configured to receive the stem 846. A force applied to the first handle lever 803 is transferred through the second handle lever 806 to the stem 846.

The first handle lever 803 may be detachably attached to the second handle lever 806. For example, the first handle lever 803 may be attached to the second handle lever 806 by a snap-fit connection as illustrated in FIGS. 8B and 8C. After aligning the post 833 with the bore 849 of the stem 846, the first and second handle levers 803/806 may be pressed together to engage the snap-fit connection as shown in the enlarged view of FIG. 8C. The snap-fit connection allows rotation of the first handle lever 803 about the post 833 independent of the second handle lever 806.

A bushing 809 is configured to extend through an opening in a wall of a toilet tank. The bushing 809 includes a passage 859, a stop 863, a lip, a rectangular segment, and a threaded segment as discussed with respect to the example of FIGS. 7A-7F, and possibly other features not discussed in detail herein. The passage extends longitudinally through the bushing 809 and is configured for the stem 846 to pass at least partially through the bushing 809. The stop 863 extends from the bushing 809 and is configured to extend through the slot 843 of the second handle lever 806 and to abut the shoulder (not shown) of the first handle lever 803 as previously described. The distal end of the bushing 809 may also be configured to detachably connect to the actuation control box 113 (FIG. 1).

The portion of the stem 846 extending from the second handle lever 806 includes a stem groove 856 at the distal end that is configured to receive a retaining element 826 to facilitate securing the first and second handle levers 803/806 to the bushing 809. To this end, the retaining element 826 may clip to the stem groove 856 to retain the stem 846 within the bushing 809. The distal end of the stem 846 can be configured to detachably engage a cam of the actuation control box 113 (FIGS. 2A-2C).

Operation of the dual flush handle assembly 800 is similar to that described with respect to the dual flush handle assembly 700 of FIGS. 7D-7F, which show progressions of the dual flush handle assembly 700 being in a neutral position, initiating a partial (or "quick") flush, and initiating a full flush, respectively.

Figure 9A:
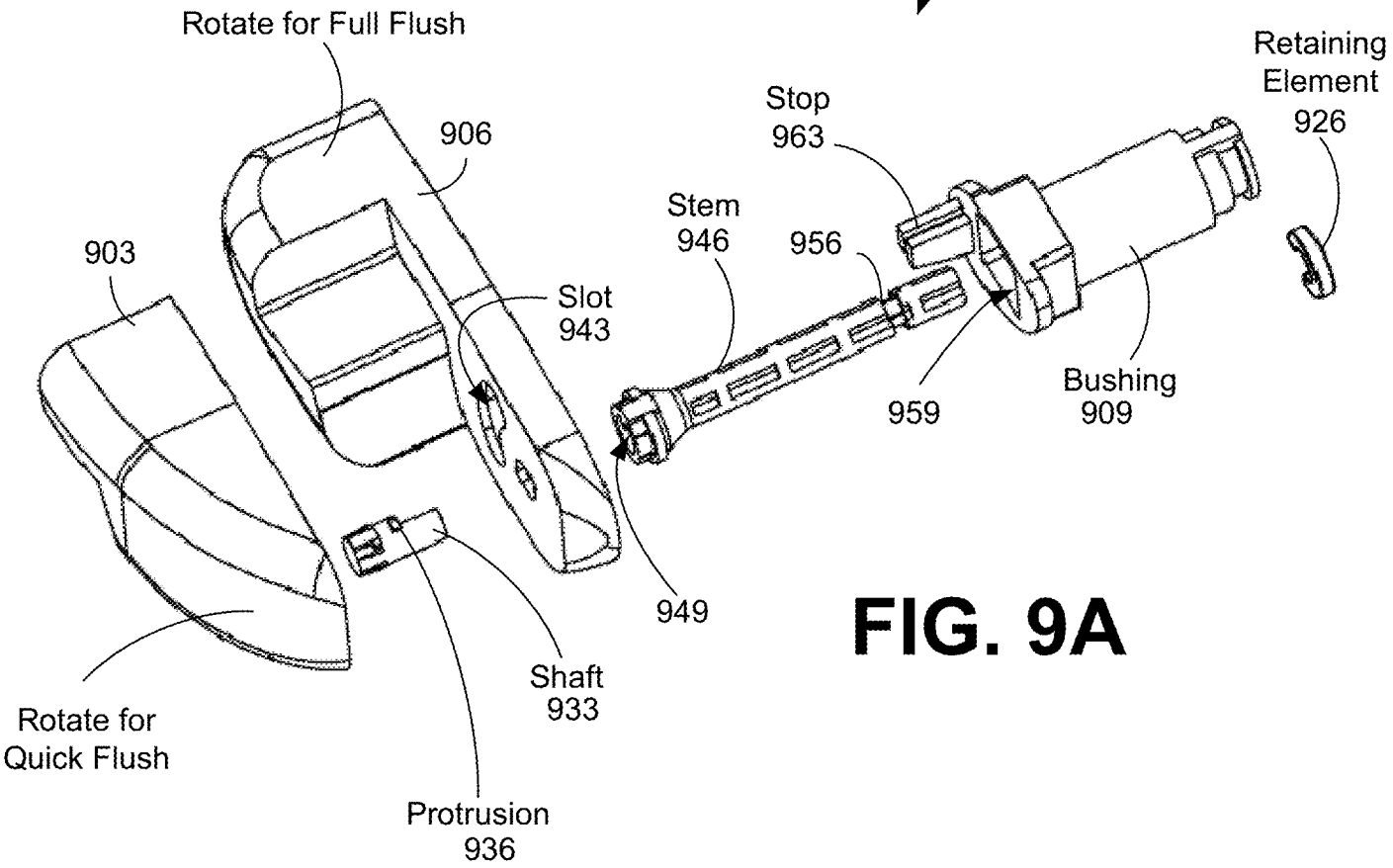
Figure 9B:
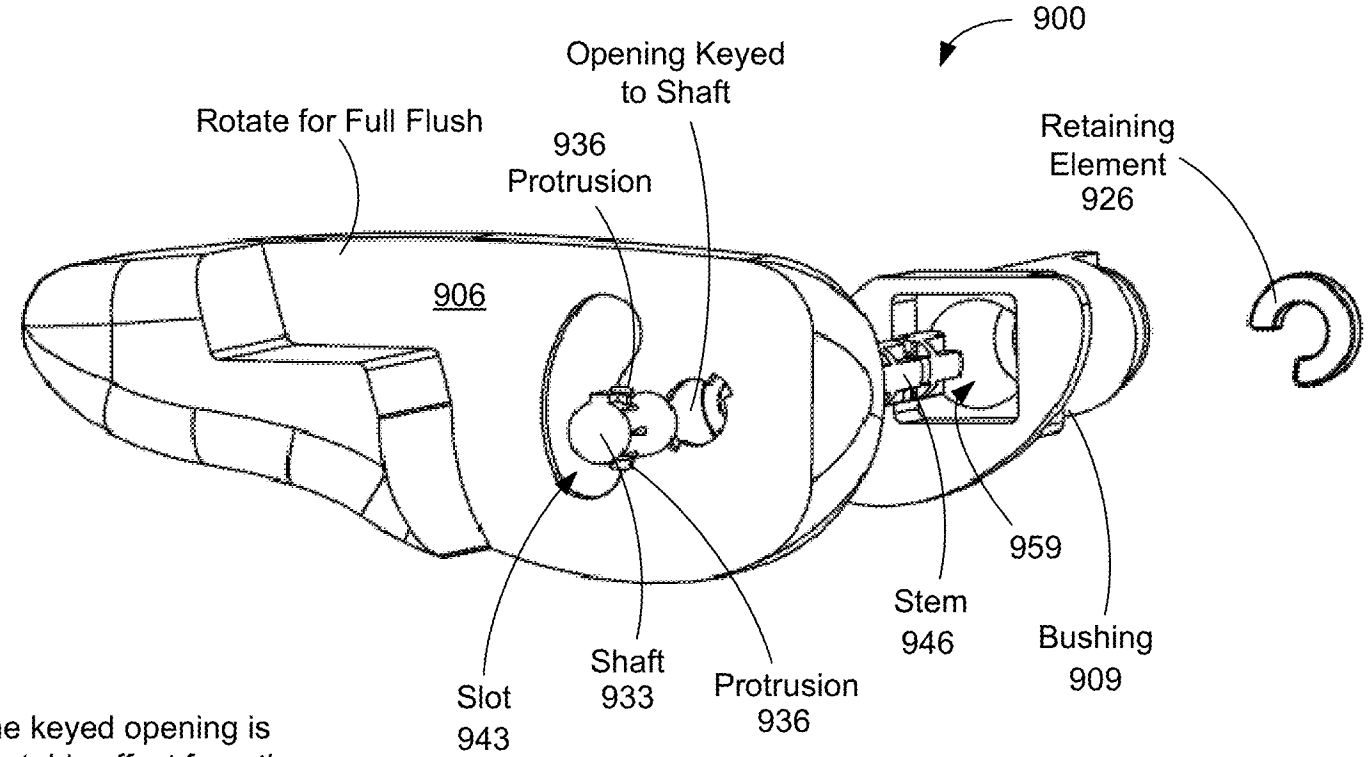
Figure 9C:
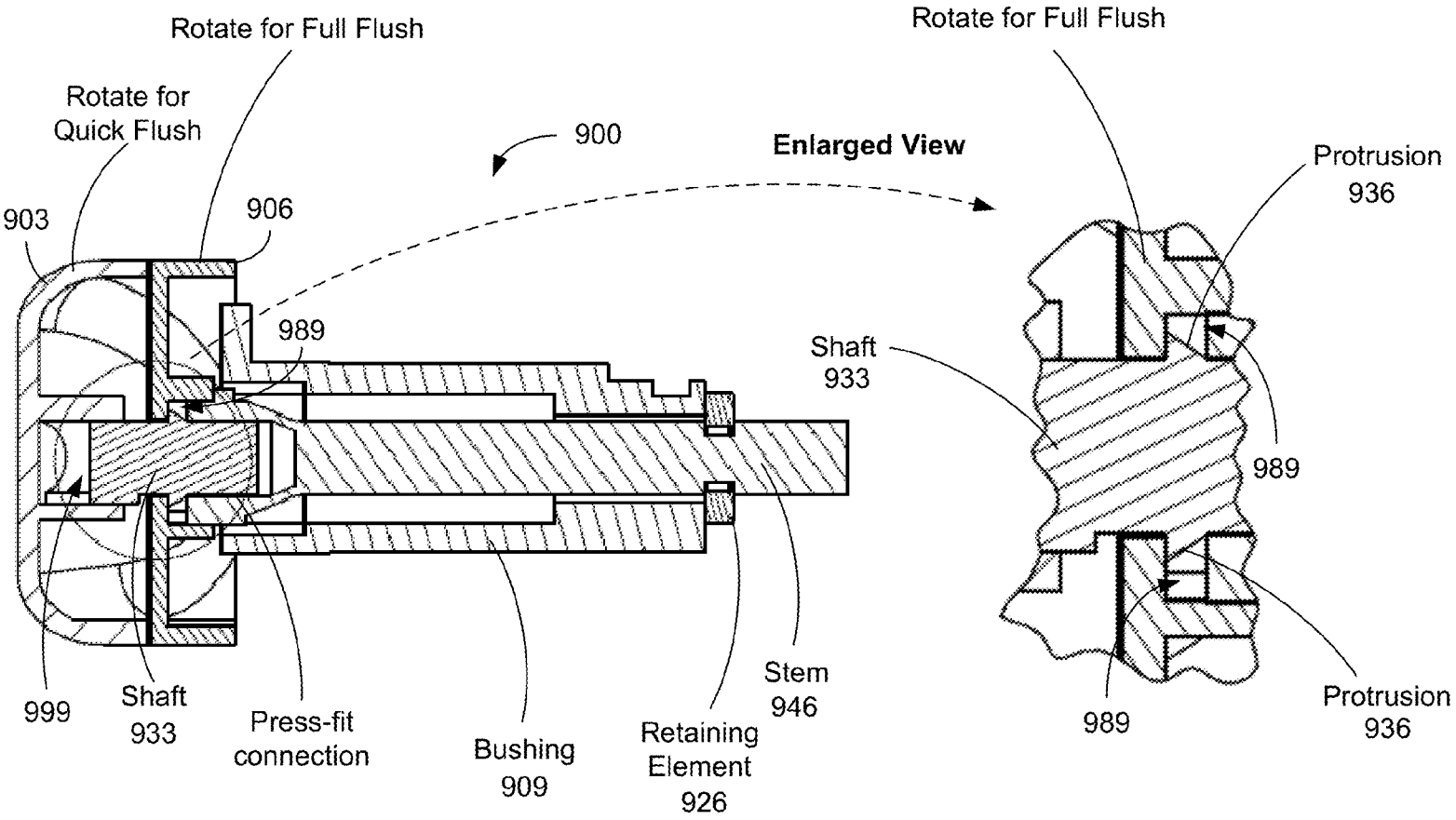

Referring next to FIGS. 9A-9C, shown is another example of a dual flush handle assembly 900 that may be used to initiate a partial flush and/or a full flush of a toilet. To this end, the dual flush handle assembly 900 may be in communication with, for example, the actuation control box 113 (FIG. 1). FIGS. 9A and 9B show exploded views of the dual flush handle assembly 900. The dual flush handle assembly 900 includes a first handle lever 903, a second handle lever 906, a bushing 909, and other components such as, e.g., springs, retaining elements, and/or damper as discussed with respect to the dual flush handle assembly 600 of FIGS. 3A-3D.

The first handle lever 903 is shaped to be nested within the second handle lever 906. The first handle lever 903 is configured to rotate about an axis by a predetermined angle of rotation. To this end, the dual flush handle assembly 900 includes a shaft 933 that, when engaged with a keyed or shaped slot 999 (FIG. 9C) of the first handle lever 903, extends from a toilet-facing side or surface of the first handle lever 903. The shaft 933 may be secured to the first handle lever 903 by a press-fit connection. The first handle lever 903 also includes a shoulder (not shown) accessible from a toilet-facing side or surface of the first handle lever 903. As with the example of FIGS. 7A-7F, the shoulder limits the rotation of the first handle lever 903. The second handle lever 906 is also configured to rotate about an axis by a predetermined angle of rotation. The second handle lever 906 may rotate by a predetermined angle of rotation that is different than the angle of rotation of the first handle lever 903. The second handle lever 906 includes a slot 943, which provides access to the shoulder of the first handle lever 903 through the second handle lever 906.

A stem 946 is detachably attached to the second handle lever 906 to extend outward from the toilet-facing side or surface of the second handle lever 906. For example, the stem 946 may be secured to the second handle lever 906 by a press-fit connection with a shaped or keyed slot 989 as illustrated in the cut-away view of FIG. 9C. The shaped or keyed slot 989 allows torque to be applied to the stem 946 via the second handle lever 906. Referring back to FIGS. 9A and 9B, the stem 946 includes a bore 949 accessible from the outward end of the stem 946. The bore 949 is configured to receive the shaft 933 of the first handle lever 903. The shaft 933 that extends through the second handle lever 906 to engage with the bore 949 of the stem 946. The shaft 933 enhances the press-fit between the stem 946 and the shaped or keyed slot 989 to secure the stem 946 to the second handle lever 906. Protrusions 936 around the shaft 933 prevent the shaft 933 from being pulled through the second handle lever 906 by the first handle lever 903 while allowing for independent rotation. A force applied to the first handle lever 903 is transferred through the second handle lever 906 to the stem 946.

A bushing 909 is configured to extend through an opening in a wall of a toilet tank. The bushing 909 includes a passage 959, a stop 963, a lip, a rectangular segment, and a threaded segment as discussed with respect to the example of FIGS. 7A-7F, and possibly other features not discussed in detail herein. The passage extends longitudinally through the bushing 909 and is configured for the stem 946 to pass at least partially through the bushing 909. The stop 963 extends from the bushing 909 and is configured to extend through the slot 943 of the second handle lever 906 and to abut the shoulder (not shown) of the first handle lever 903 as described previously. The distal end of the bushing 909 may also be configured to detachably connect to the actuation control box 113 (FIG. 1).

The portion of the stem 946 extending from the second handle lever 906 includes a stem groove 956 at the distal end that is configured to receive a retaining element 926 to facilitate securing the first and second handle levers 903/906 to the bushing 909. To this end, the retaining element 926 may clip to the stem groove 956 to retain the stem 946 within the bushing 909. The distal end of the stem 946 can be configured to detachably engage a cam of the actuation control box 113 (FIGS. 2A-2C).

Operation of the dual flush handle assembly 900 is similar to that described with respect to the dual flush handle assembly 700 of FIGS. 7D-7F, which show progressions of the dual flush handle assembly 700 being in a neutral position, initiating a partial (or "quick") flush, and initiating a full flush, respectively.

Figure 10A:
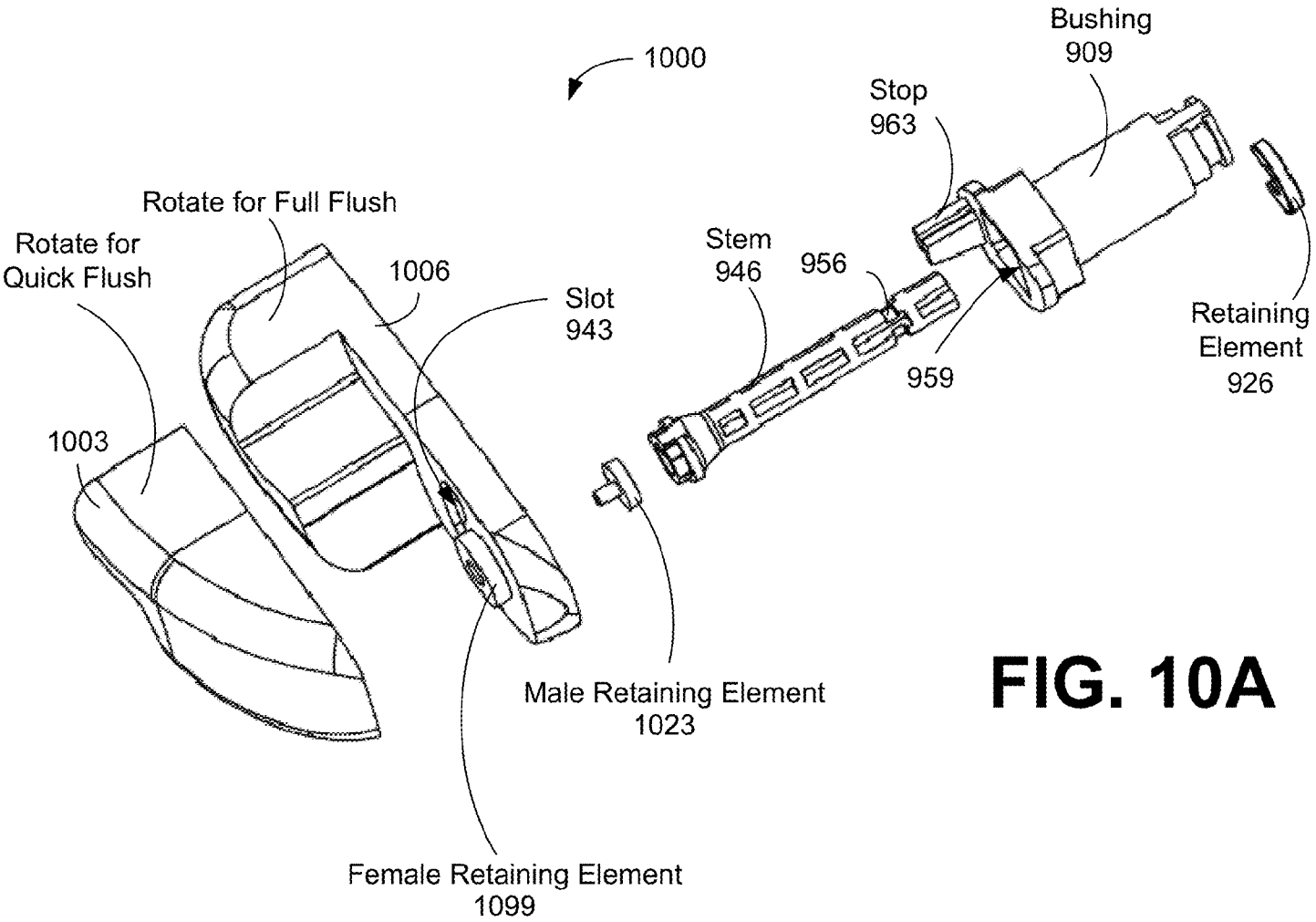
Figure 10B:
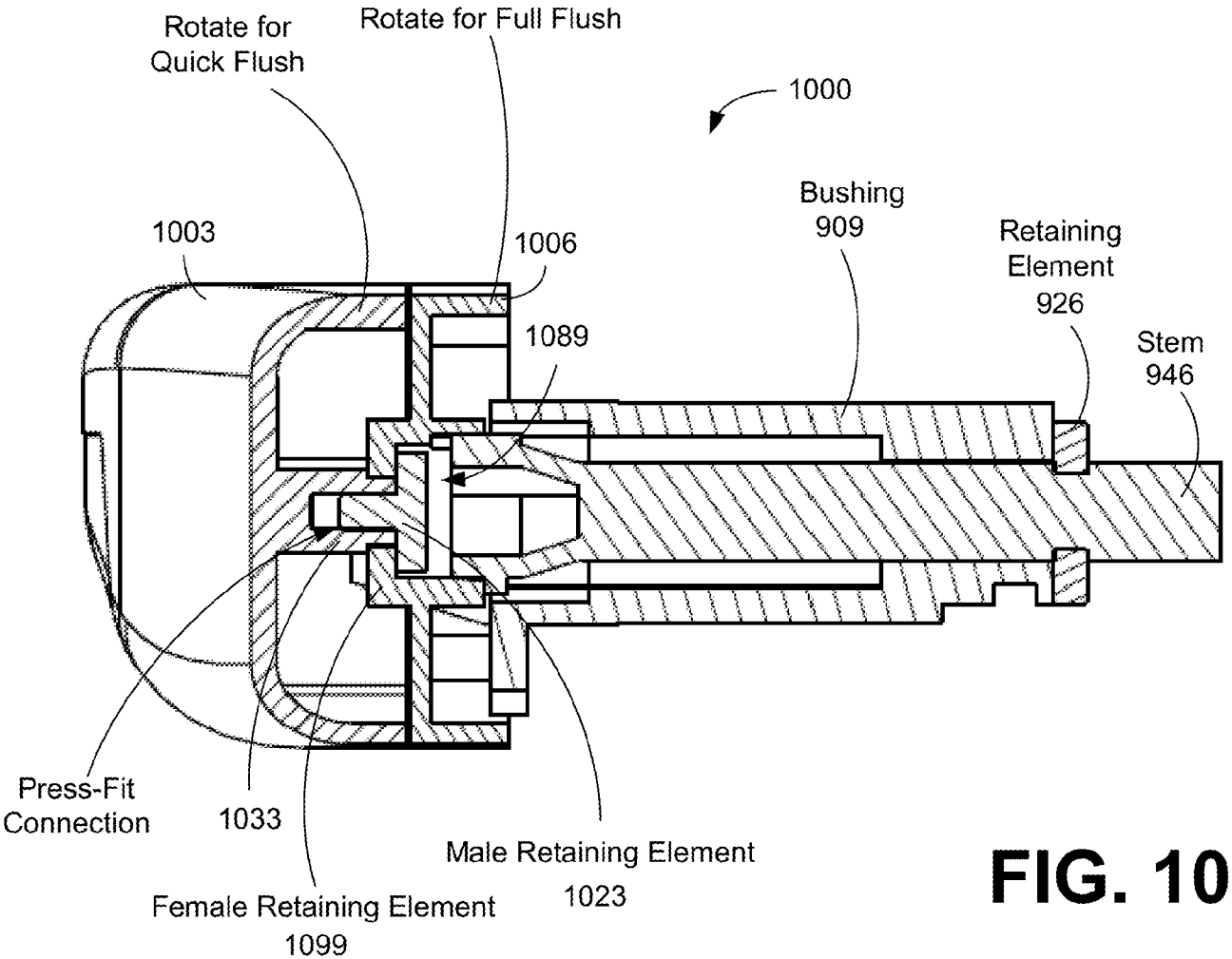

Referring now to FIGS. 10A and 10B, shown is another example of a dual flush handle assembly 1000 that may be used to initiate a partial flush and/or a full flush of a toilet. The example of FIGS. 10A and 10B is similar to the example of FIGS. 9A-9C with the first handle lever 1003 detachably attached to the second handle lever 1006 using a male retaining element 1023 and a female retaining element 1099. As shown in the cut-away view of FIG. 10B, a post 1033 of the first handle lever 1003 extends into and/or through female retaining element 1099 of the second handle lever 1006. A shoulder of the post 1033, which fits against an outer face of the female retaining element 1099, positions the first handle lever 1003 with respect to the second handle lever 1006. A protrusion of the male retaining element 1023 engages a recess of the post 1033 through a shaped or keyed slot 1089 as illustrated in the cut-away view of FIG. 10B. A press-fit connection between the protrusion of the male retaining element 1023 and the recess of the post 1033 secures the first handle lever 1003 in position. A stem 946 is detachably attached to the second handle lever 1006 to extend outward from the toilet-facing side or surface of the second handle lever 1006. The stem 946 may be secured to the second handle lever 1006 by a press-fit connection with the shaped or keyed slot 1089 as illustrated in the cut-away view of FIG. 10B. The shaped or keyed slot 1089 allows torque to be applied to the stem 946 via the second handle lever 1006 as described with respect to the example of FIGS. 9A-9C.

Figure 11A:
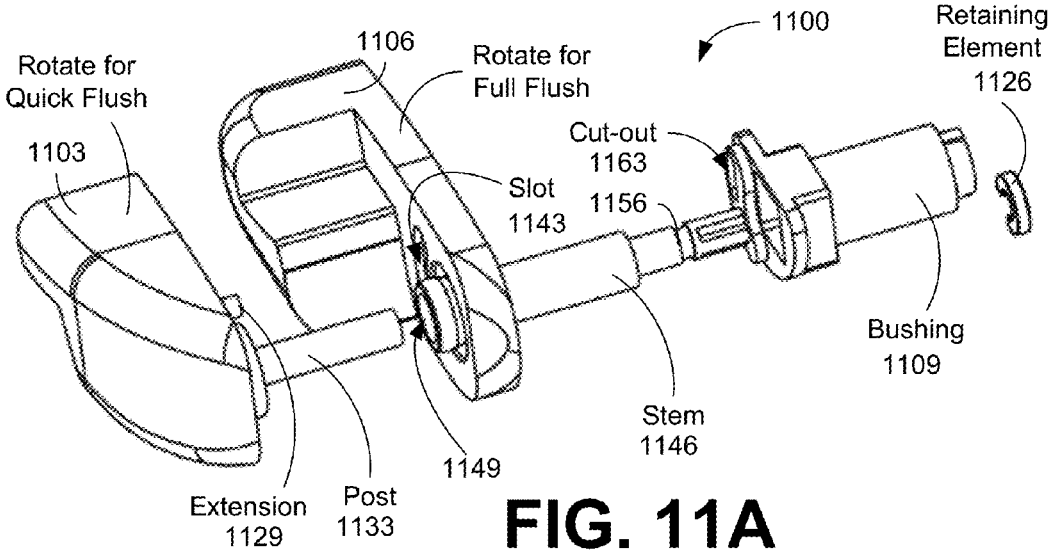
Figure 11B:
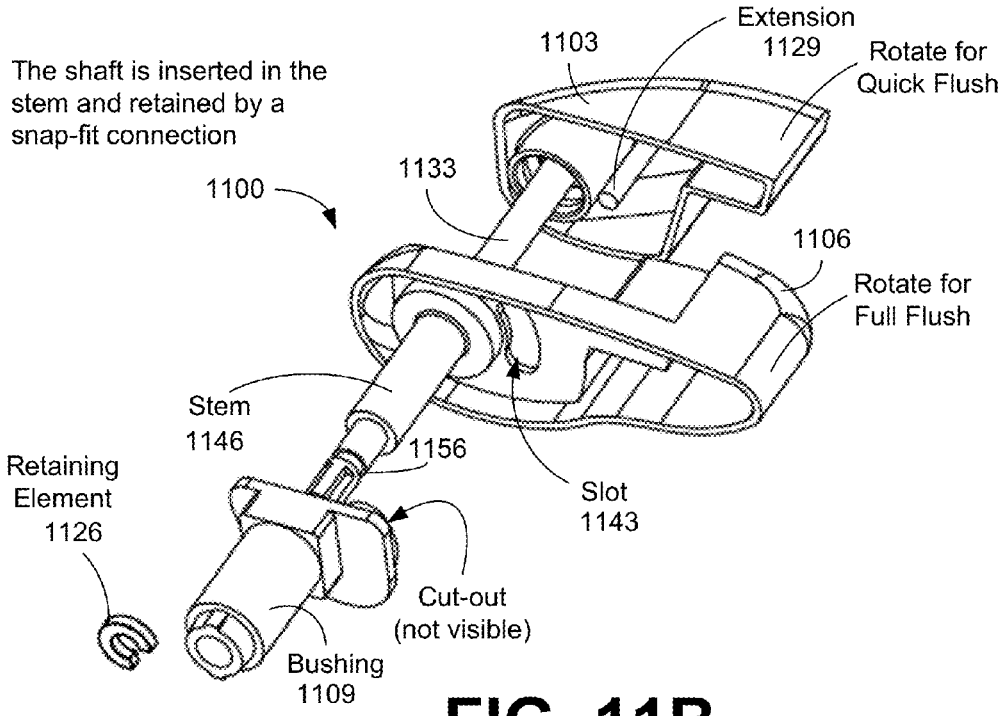

Referring next to FIGS. 11A-11E, shown is another example of a dual flush handle assembly 1100. The dual flush handle assembly 1100 may be used to initiate a partial flush and/or a full flush of a toilet. To this end, the dual flush handle assembly 1100 may be in communication with, for example, the actuation control box 113 (FIG. 1). FIGS. 11A and 11B show exploded views of the dual flush handle assembly 1100. The dual flush handle assembly 1100 includes a first handle lever 1103, a second handle lever 1106, a bushing 1109, and other components such as, e.g., springs, retaining elements, and/or damper as discussed with respect to the dual flush handle assembly 600 of FIGS. 3A-3D.

The first handle lever 1103 is shaped to be nested within the second handle lever 1106. In this sense, the first handle lever 1103 and second handle lever 1106 are formed to facilitate at least a portion of the first handle lever 1103 "fitting" within a portion of the second handle lever 1106. The second handle lever 1106 may fit within a profile of the first handle 1103 so as to promote the appearance of a single handle. Accordingly, the dual flush handle assembly 1100 may present an appearance of a conventional toilet flush lever, while providing the functionality of a dual flush handle control.

The first handle lever 1103 is configured to rotate about an axis by a predetermined angle of rotation. To this end, the first handle lever 1103 includes an extension 1129 and post 1133, both extending from a toilet-facing side or surface of the first handle lever 1103. In various embodiments, the post 1133 includes a snap-fit connection to facilitate retaining the first handle lever 1103 to the dual flush handle assembly 1100. In other implementations, the post 1133 may include a post groove to facilitate retaining the first handle lever 1103 to the dual flush handle assembly 1100.

The second handle lever 1106 is also configured to rotate about an axis by a predetermined angle of rotation. It is emphasized that the second handle lever 1106 may rotate by a predetermined angle of rotation that is different than the angle of rotation of the first handle lever 1103. The second handle lever 1106 includes a slot 1143, which allows the extension 1129 to pass through the second handle lever 1106.

A stem 1146 may be integrally cast as part of the second handle lever 1106 to extend from both the outward and toilet-facing sides or surfaces of the second handle lever 1106. In alternative embodiments, the stem 1146 may extend from only one of the outward or toilet-facing surfaces of the second handle lever 1106. The stem 1146 includes a bore 1149 accessible from the outward end of the stem 1146. The bore 1149 is configured to receive the post 1133 of the first handle lever 1103. Although the stem 1146 shown in FIGS. 11A and 11B is configured to receive the post 1133, in alternative embodiments the post 1133 may include a bore configured to receive the stem 1146. A force applied to the first handle lever 1103 is transferred through the second handle lever 1106 to the stem 1146.

The first handle lever 1103 may be detachably attached to the second handle lever 1106. For example, the first handle lever 1103 may be attached to the second handle lever 1106 by a snap-fit connection as illustrated in FIGS. 8B and 8C. After aligning the post 1133 with the bore 1149 of the stem 1146, the first and second handle levers 1103/1106 may be pressed together to engage the snap-fit connection as shown in the enlarged view of FIG. 8C. The snap-fit connection allows rotation of the first handle lever 1103 about the post 1133 independent of the second handle lever 1106.

A bushing 1109 is configured to extend through an opening in a wall of a toilet tank. The bushing 1109 includes a cut-out 1163. The bushing 1109 also includes a passage, a lip, a rectangular segment, a threaded segment as discussed with respect to the example of FIGS. 7A-7F, and possibly other features not discussed in detail herein. The passage extends longitudinally through the bushing 1109 and is configured for the stem 1146 to pass at least partially through the bushing 1109. The cut-out 1163 includes a slot configured to receive the extension 1129 through the slot 1143 of the second handle lever 1106. The distal end of the bushing 1109 may also be configured to detachably connect to the actuation control box 113 (FIG. 1).

The portion of the stem 1146 extending from the second handle lever 1106 includes a stem groove 1156 at the distal end. The stem groove 1156 is configured to receive a retaining element 1126 to facilitate securing the first and second handle levers 1103/1106 to the bushing 1109. To this end, with the stem groove 1156 extending through the passage of the bushing 1109, the retaining element 1126 may clip to the stem groove 1156 to retain the stem 1146 within the bushing 1109. Thus, the retaining element 1126 may retain the second handle lever 1106 to the bushing 1109 in a lateral position, while facilitating rotation of the second handle lever 1106 and/or first handle lever 1103 with respect to the bushing 1109. The distal end of the stem 1146 can be configured to detachably engage a cam of the actuation control box 113 (FIGS. 2A-2C).

The lip of the bushing 1109 is configured to abut an exterior surface of a toilet tank. The rectangular segment is configured to be secured in a corresponding opening in the toilet tank wall, thereby preventing rotational movement of the bushing 1109 with respect to the toilet tank wall. The threaded segment of the bushing 1109 is configured to receive an appropriately threaded nut that abuts an interior surface of the toilet tank wall, thereby preventing translational movement of the bushing 1109 with respect to the toilet tank.

Figure 11C:
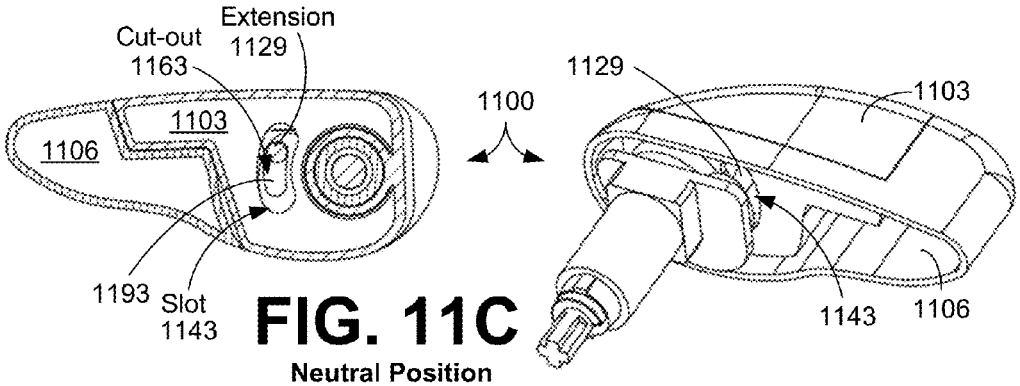
Figure 11D:
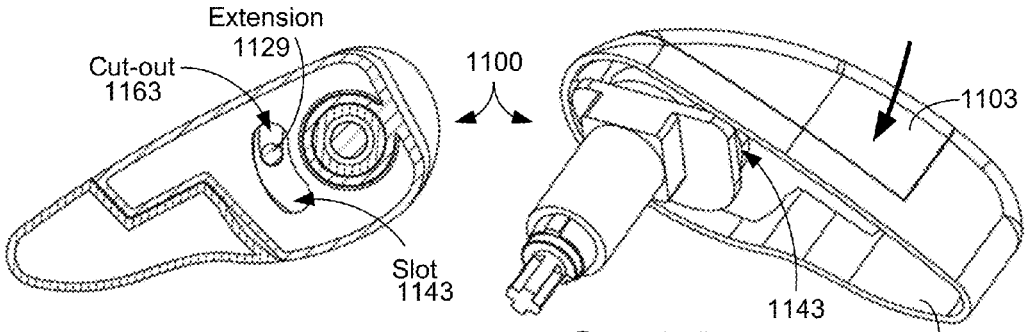
Figure 11E:
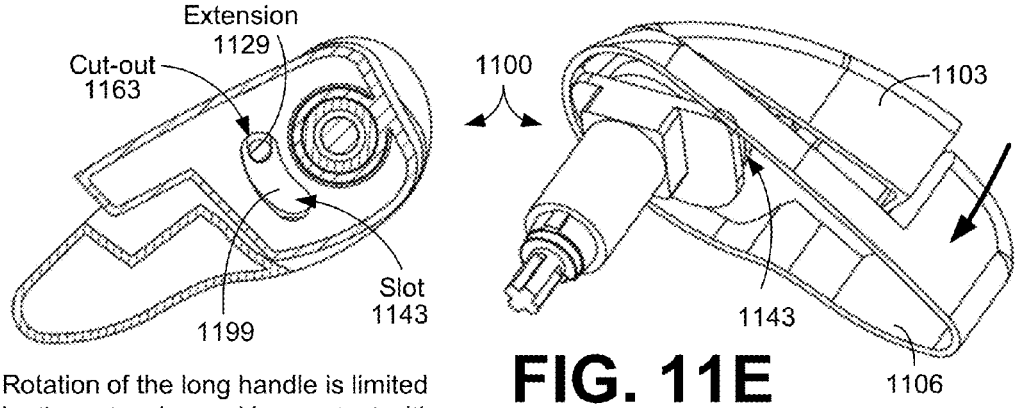

Next, a description of the general operation of the dual flush handle assembly 1100 is provided. FIGS. 11C, 11D, and 11E show progressions of the dual flush handle assembly 1100 being in a neutral position, initiating a partial (or "quick") flush, and initiating a full flush, respectively.

With reference to FIG. 11C, shown is the dual flush handle assembly 1100 in a neutral position according to various embodiments of the present disclosure. The neutral position shown is the position to which the dual flush handle assembly 1100 returns after a flush has been initiated. As shown in FIG. 11C, the cut-out 1163 of the bushing 1109 is positioned adjacent to the slot 1143 of the second handle lever 1106. Also, the extension 1129 of the second handle lever extends through the slot 1143 of the second handle lever 1106. As best shown in the cut-away view of FIG. 11C, there is a space 1193 between the extension 1129 and the lower edge of the cut-out 1163. Further, when the dual flush handle assembly 1100 is in the neutral position the extension 1129 is located below an upper edge of the slot 1143.

Turning now to FIG. 11D, shown is the dual flush handle assembly 1100 in a position configured to initiate a partial (or "quick") flush of a toilet. The dual flush handle assembly 1100 may arrive in this position, for example, by a user pressing on the first handle lever 1103 as indicated by the arrow. Rotating the first handle lever 1103 pushes against the second handle lever 1106 causing the second handle lever 1106, and thus the stem 1146, to rotate. The rotation of the first handle lever 1103 is limited by the lower edge of the cut-out 1163 of the bushing 1109 making contact with the extension 1129 of the first handle lever 1103. By rotating the first handle lever 1103 by the amount limited by the extension 1129 and cut-out 1163, the stem 1146 rotates a predetermined amount to initiate a partial flush, for example, through the actuation control box 113 (FIG. 1) as described above.

After a partial flush has been initiated, the dual flush handle assembly 1100 may automatically return to the neutral position shown in FIG. 11C. To this, end, a spring or other appropriate mechanism may cause the dual flush handle assembly 1100 to return to the neutral position.

Turning to FIG. 11E, shown is the dual flush handle assembly 1100 in a position configured to initiate a full flush of a toilet. The dual flush handle assembly 1100 may arrive in this position, for example, by a user pressing the second handle lever 1106 as indicated by the arrow. By pressing on the second handle lever 1106, the first handle lever 1103 rotates until the extension of the bushing 1109 contacts the upper edge of the slot 1143 of the first handle lever 1103. While the first handle lever 1103 stops rotating when the cut-out 1163 engages with the extension 1129, the second handle lever 1106 may continue to rotate until the upper edge of the slot 1143 of the second handle lever 1106 contacts the extension 1129 of the first handle lever 1103. Thus, the stem 1146 may rotate to initiate a full flush of a toilet, for example, via the actuation control box 113 (FIG. 1).

As best shown in cut-away view of FIG. 11E, the extension 1129 engages with the upper edge of the slot 1143 of the second handle lever 1106. Thus, the slot 1143 in conjunction with the extension 1129 acts to define the predetermined angle of rotation. With the dual flush handle assembly 1100 in the position configured to initiate a full flush, the space 1199 between the extension 1129 and the lower edge of the slot 1143 has widened.

After a full flush has been initiated, the dual flush handle assembly 1100 may automatically return to the neutral position shown in FIG. 11C. To this end, a spring or other appropriate mechanism may return the dual flush handle assembly 1100 to the neutral position. In alternative embodiments, the dual flush handle assembly 1100 may return to the neutral position using other mechanisms. As non-limiting examples, the dual flush handle assembly 1100 may return to the neutral position due its own weight, from a flush valve dropping due to a drop in water level in the toilet tank, from a spring force inside the activation control box 113 (FIG. 1), from a spring force associated with a flush valve, or from any other mechanism.

Figure 12A:
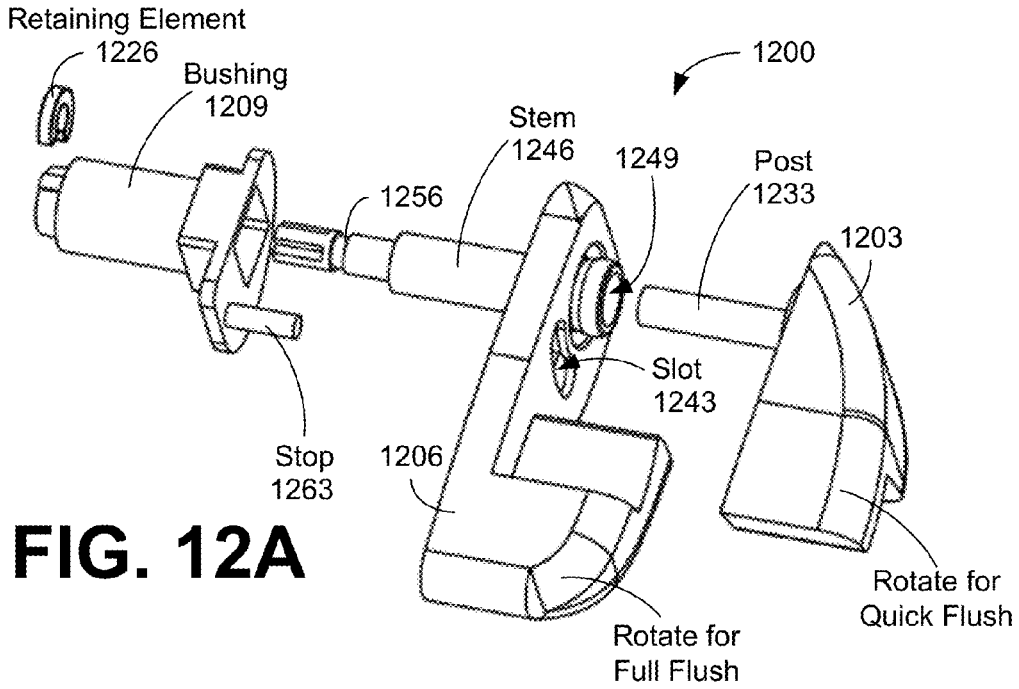
Figure 12B:
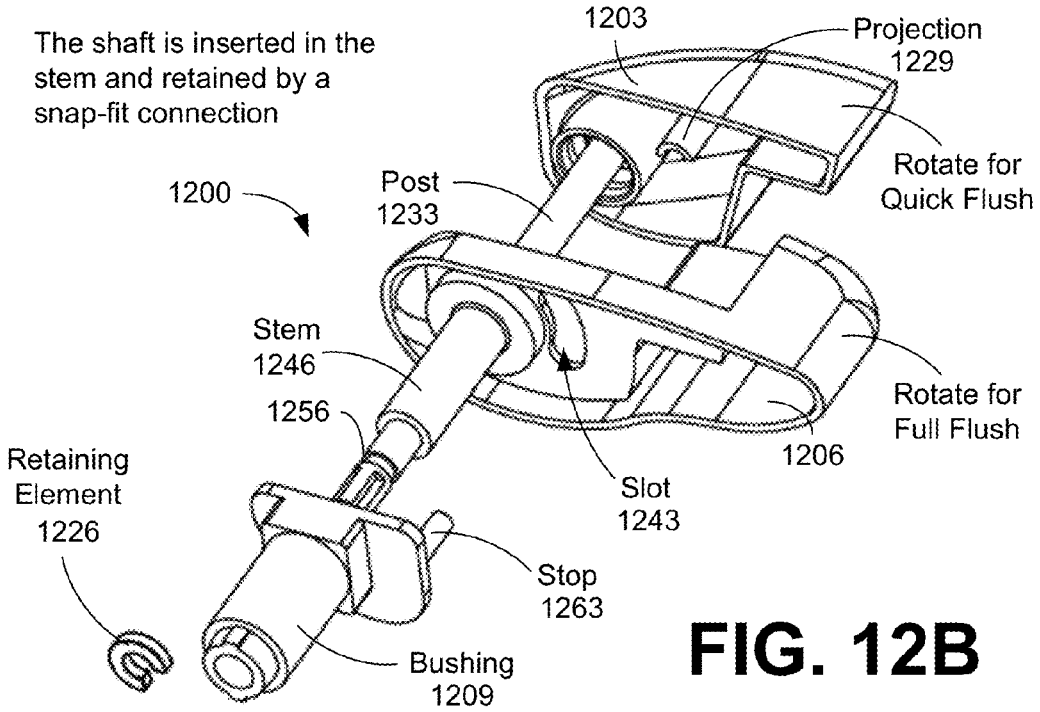

Referring next to FIGS. 12A-12E, shown is another example of a dual flush handle assembly 1200. The dual flush handle assembly 1200 may be used to initiate a partial flush and/or a full flush of a toilet. To this end, the dual flush handle assembly 1200 may be in communication with, for example, the actuation control box 113 (FIG. 1). FIGS. 12A and 12B show exploded views of the dual flush handle assembly 1200. The dual flush handle assembly 1200 includes a first handle lever 1203, a second handle lever 1206, a bushing 1209, and other components such as, e.g., springs, retaining elements, and/or damper as discussed with respect to the dual flush handle assembly 600 of FIGS. 3A-3D.

The first handle lever 1203 is shaped to be nested within the second handle lever 1206. In this sense, the first handle lever 1203 and second handle lever 1206 are formed to facilitate at least a portion of the first handle lever 1203 "fitting" within a portion of the second handle lever 1206. The second handle lever 1206 may fit within a profile of the first handle 1203 so as to promote the appearance of a single handle. Accordingly, the dual flush handle assembly 1200 may present an appearance of a conventional toilet flush lever, while providing the functionality of a dual flush handle control.

The first handle lever 1203 is configured to rotate about an axis by a predetermined angle of rotation. To this end, the first handle lever 1203 includes projection 1229 and post 1233, both extending from a toilet-facing side or surface of the first handle lever 1203. In various embodiments, the post 1233 includes a snap-fit connection to facilitate retaining the first handle lever 1203 to the dual flush handle assembly 1200. In other implementations, the post 1233 may include a post groove to facilitate retaining the first handle lever 1203 to the dual flush handle assembly 1200.

The second handle lever 1206 is also configured to rotate about an axis by a predetermined angle of rotation. It is emphasized that the second handle lever 1206 may rotate by a predetermined angle of rotation that is different than the angle of rotation of the first handle lever 1203. The second handle lever 1206 includes a slot 1243, which allows the projection 1229 to pass through the second handle lever 1206.

A stem 1246 may be integrally cast as part of the second handle lever 1206 to extend from both the outward and toilet-facing sides or surfaces of the second handle lever 1206. In alternative embodiments, the stem 1246 may extend from only one of the outward or toilet-facing surfaces of the second handle lever 1206. The stem 1246 includes a bore 1249 accessible from the outward end of the stem 1246. The bore 1249 is configured to receive the post 1233 of the first handle lever 1203. Although the stem 1246 shown in FIGS. 12A and 12B is configured to receive the post 1233, in alternative embodiments the post 1233 may include a bore configured to receive the stem 1246. A force applied to the first handle lever 1203 is transferred through the second handle lever 1206 to the stem 1246.

The first handle lever 1203 may be detachably attached to the second handle lever 1206. For example, the first handle lever 1203 may be attached to the second handle lever 1206 by a snap-fit connection as illustrated in FIGS. 8B and 8C. After aligning the post 1233 with the bore 1249 of the stem 1246, the first and second handle levers 1203/1206 may be pressed together to engage the snap-fit connection as shown in the enlarged view of FIG. 8C. The snap-fit connection allows rotation of the first handle lever 1203 about the post 1233 independent of the second handle lever 1206.

A bushing 1209 is configured to extend through an opening in a wall of a toilet tank. The bushing 1209 includes a stop 1263. The bushing 1209 also includes a passage, a lip, a rectangular segment, a threaded segment as discussed with respect to the example of FIGS. 7A-7F, and possibly other features not discussed in detail herein. The passage extends longitudinally through the bushing 1209 and is configured for the stem 1246 to pass at least partially through the bushing 1209. The stop 1263 extends from the bushing 1209 and is configured to extend through the slot 1243 of the second handle lever 1206 and to abut the projection 1229 of the first handle lever 1203 as will be later described. The distal end of the bushing 1209 may also be configured to detachably connect to the actuation control box 113 (FIG. 1).

The portion of the stem 1246 extending from the second handle lever 1206 includes a stem groove 1256 at the distal end. The stem groove 1256 is configured to receive a retaining element 1226 to facilitate securing the first and second handle levers 1203/1206 to the bushing 1209. To this end, with the stem groove 1256 extending through the passage of the bushing 1209, the retaining element 1226 may clip to the stem groove 1256 to retain the stem 1246 within the bushing 1209. Thus, the retaining element 1226 may retain the second handle lever 1206 to the bushing 1209 in a lateral position, while facilitating rotation of the second handle lever 1206 and/or first handle lever 1203 with respect to the bushing 1209. The distal end of the stem 1246 can be configured to detachably engage a cam of the actuation control box 113 (FIGS. 2A-2C).

The lip of the bushing 1209 is configured to abut an exterior surface of a toilet tank. The rectangular segment is configured to be secured in a corresponding opening in the toilet tank wall, thereby preventing rotational movement of the bushing 1209 with respect to the toilet tank wall. The threaded segment of the bushing 1209 is configured to receive an appropriately threaded nut that abuts an interior surface of the toilet tank wall, thereby preventing translational movement of the bushing 1209 with respect to the toilet tank.

Figure 12C:
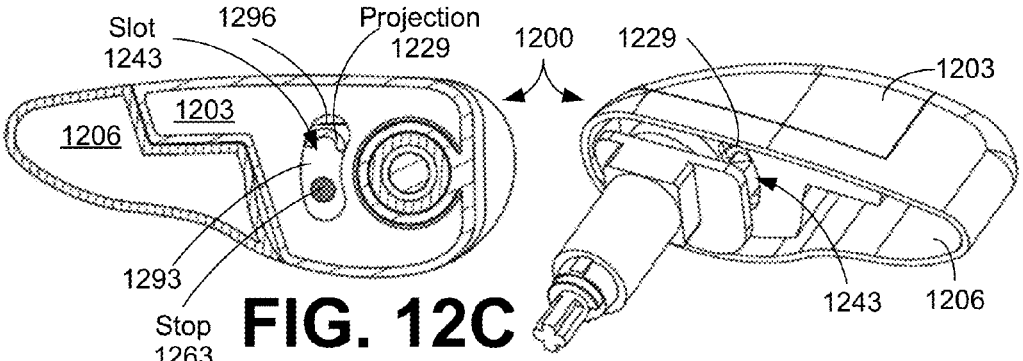
Figure 12D:
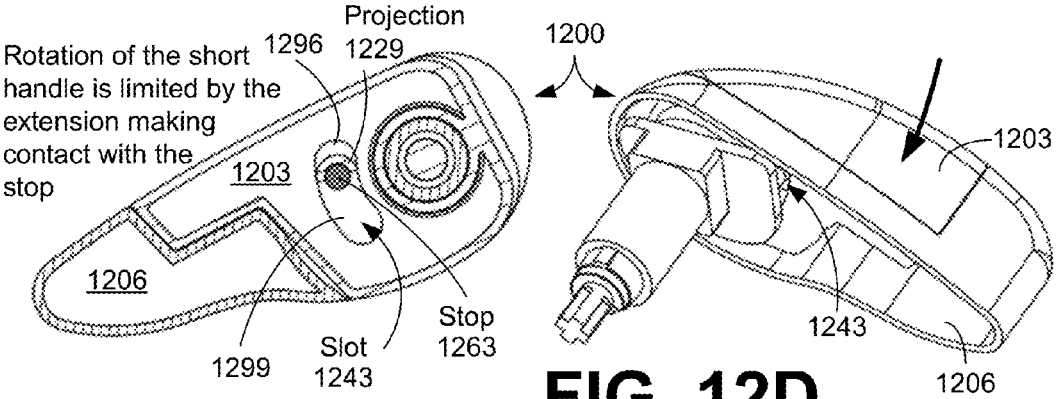
Figure 12E:
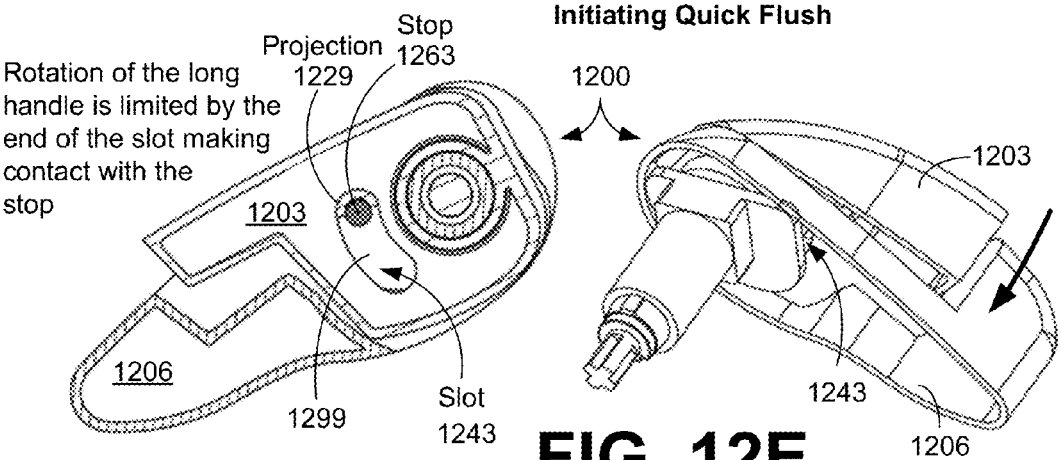

Next, a description of the general operation of the dual flush handle assembly 1200 is provided. FIGS. 12C, 12D, and 12E show progressions of the dual flush handle assembly 1200 being in a neutral position, initiating a partial (or "quick") flush, and initiating a full flush, respectively.

With reference to FIG. 12C, shown is the dual flush handle assembly 1200 in a neutral position according to various embodiments of the present disclosure. The neutral position shown is the position to which the dual flush handle assembly 1200 returns after a flush has been initiated. As shown in FIG. 12C, the projection 1229 of the first handle lever 1203 is positioned within the slot 1243 of the second handle lever 1206. Also, the stop 1263 of the bushing 1209 is positioned within the slot 1243 of the second handle lever 1206. As best shown in the cut-away view of FIG. 12C, there is a space 1293 between the stop 1263 and the projection 1229. Further, there is a space 1296 between the projection 1229 and an upper edge of the slot 1243. Additionally, the stop 1263 of the bushing 1209 is engaged with the opposite edge of the slot 1243.

Turning now to FIG. 12D, shown is the dual flush handle assembly 1200 in a position configured to initiate a partial (or "quick") flush of a toilet. The dual flush handle assembly 1200 may arrive in this position, for example, by a user pressing on the first handle lever 1203 as indicated by the arrow. Rotating the first handle lever 1203 pushes against the second handle lever 1206 causing the second handle lever 1206, and thus the stem 1246, to rotate as well. The rotation of the first handle lever 1203 is limited by the projection 1229 of the first handle lever 1203 making contact with the stop 1263 of the bushing 1209. By rotating the first handle lever 1203 by the predetermined amount, the stem 1246 rotates to initiate a partial flush, for example, through the actuation control box 113 (FIG. 1).

With the projection 1229 engaging the stop 1263, there is a space 1299 between the stop 1263 and a lower edge of the slot 1243. Additionally, the space 1296 between the projection 1229 and lower end of the slot 1243 still exists.

After a partial flush has been initiated, the dual flush handle assembly 1200 may automatically return to the neutral position shown in FIG. 12C. To this, end, a spring or other appropriate mechanism may cause the dual flush handle assembly 1200 to return to the neutral position.

Turning to FIG. 12E, shown is the dual flush handle assembly 1200 in a position configured to initiate a full flush of a toilet. The dual flush handle assembly 1200 may arrive in this position, for example, by a user pressing the second handle lever 1206. By pressing on the second handle lever 1206 as indicated by the arrow, the first handle lever 1203 to rotate in conjunction with the second handle lever 1206 until the projection 1229 of the first handle lever 1203 contacts the stop 1263 of the bushing 1209. While the first handle lever 1203 stops rotating, the second handle lever 1206 may continue to rotate until the upper edge of the slot 1243 of the second handle lever 1206 contacts the projection 1229 of the first handle lever 1203. Thus, the stem 1246 may rotate to initiate a full flush of a toilet, for example, via the actuation control box 113 (FIG. 1).

As best shown in the cut-away view of FIG. 12E, the stop 1263 abuts the projection 1229, and the projection 1229 engages the upper edge of the slot 1243 of the second handle lever 1206. Thus, the slot 1243 in conjunction with the projection 1229 acts to define the predetermined angle of rotation. With the dual flush handle assembly 1200 in the position configured to initiate a full flush, the space 1296 (FIG. 12C) between the projection 1229 and upper edge of the slot 1243 no longer exists. Additionally, the space 1299 between the stop 1263 and lower edge of the slot 1243 has widened.

After a full flush has been initiated, the dual flush handle assembly 1200 may automatically return to the neutral position shown in FIG. 12C. To this end, a spring or other appropriate mechanism may return the dual flush handle assembly 1200 to the neutral position. In alternative embodiments, the dual flush handle assembly 1200 may return to the neutral position using other mechanisms. As non-limiting examples, the dual flush handle assembly 1200 may return to the neutral position due its own weight, from a flush valve dropping due to a drop in water level in the toilet tank, from a spring force inside the activation control box 113 (FIG. 1), from a spring force associated with a flush valve, or from any other mechanism.

Figure 13A:
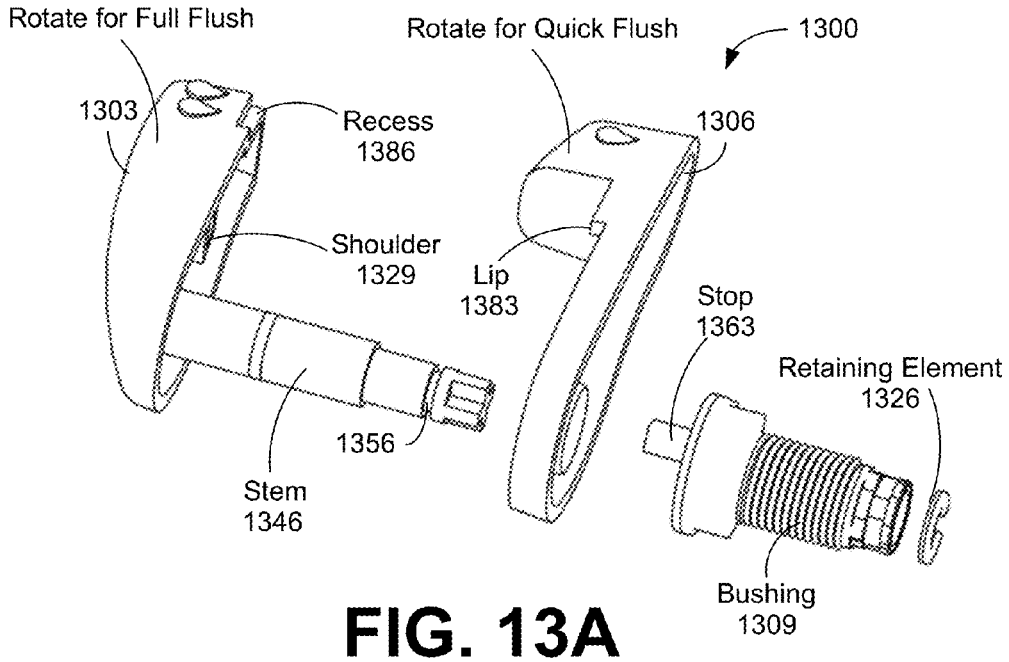
Figure 13B:
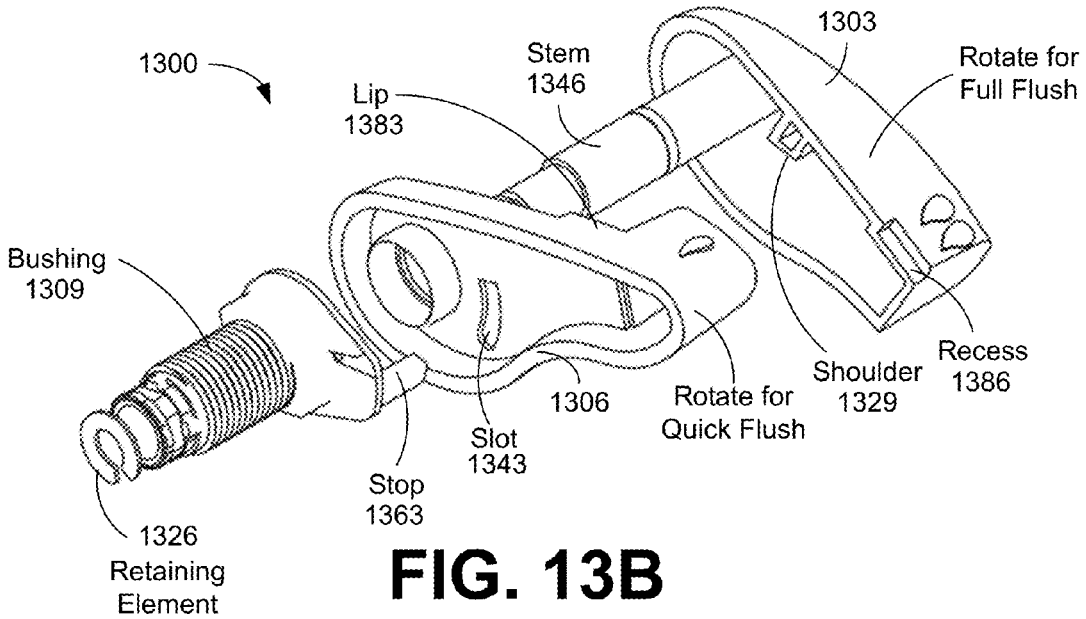
Figure 13C:
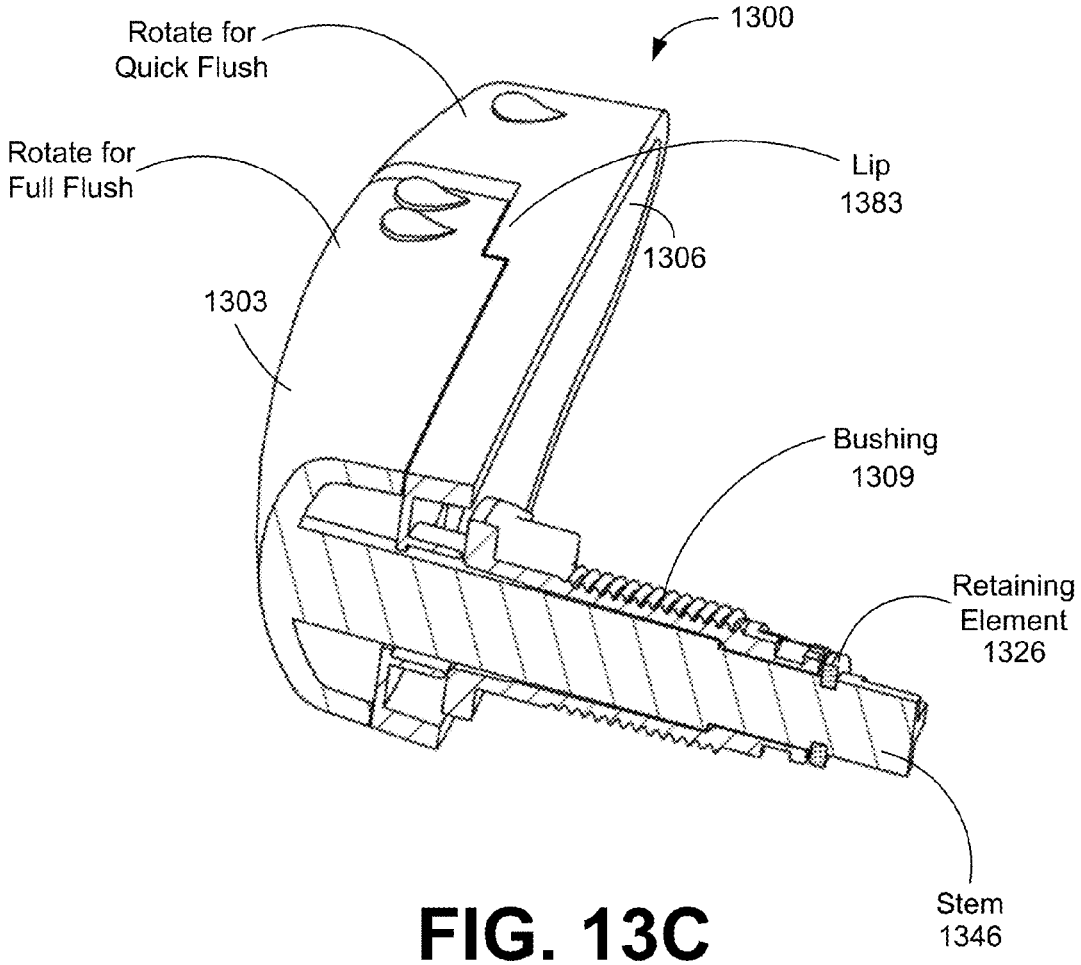

Referring next to FIGS. 13A-13F, shown is another example of a dual flush handle assembly 1300. The dual flush handle assembly 1300 may be used to initiate a partial flush and/or a full flush of a toilet. To this end, the dual flush handle assembly 1300 may be in communication with, for example, the actuation control box 113 (FIG. 1). FIGS. 13A and 13B show exploded views of the dual flush handle assembly 1300. The dual flush handle assembly 1300 includes a first handle lever 1303, a second handle lever 1306, a bushing 1309, and other components such as, e.g., springs, retaining elements, and/or damper as discussed with respect to the dual flush handle assembly 600 of FIGS. 3A-3D.

The first handle lever 1303 is shaped to be nested within the second handle lever 1306. In this sense, the first handle lever 1303 and second handle lever 1306 are formed to facilitate at least a portion of the first handle lever 1303 "fitting" within a portion of the second handle lever 1306. The second handle lever 1306 may fit within a profile of the first handle 1303 so as to promote the appearance of a single handle. Accordingly, the dual flush handle assembly 1300 may present an appearance of a conventional toilet flush lever, while providing the functionality of a dual flush handle control.

The first handle lever 1303 is configured to rotate about an axis by a predetermined angle of rotation. To this end, the first handle lever 1303 includes a shoulder 1329 accessible from a toilet-facing side or surface of the first handle lever 1303. The shoulder 1329 limits the rotation of the first handle lever 1303. The second handle lever 1306 is also configured to rotate about an axis by a predetermined angle of rotation. It is emphasized that the second handle lever 1306 may rotate by a predetermined angle of rotation that is different than the angle of rotation of the first handle lever 1303. The second handle lever 1306 includes a slot 1343, which provides access to the shoulder 1329 of the first handle lever 1303 through the second handle lever 1306. The second handle lever 1306 also includes a lip (or tab) 1383 that engages with a recess 1386 of the first handle lever 1303. Rotation of the second handle lever 1306 engages the lip 1383 with the recess 1386 to cause corresponding rotation of the first handle lever 1303. The first handle lever 1303 may be rotated without producing a corresponding rotation of the second handle lever 1306. When the first handle lever 1303 is rotated, the lip 1383 is disengaged from the recess 1386, allowing the second handle lever 1306 to remain stationary.

A stem 1346 is attached to the first handle lever 1303 to extend outward from the toilet-facing side or surface of the first handle lever 1303. For example, the stem 1346 may be integrally cast with the first handle lever 1303 as illustrated in the cut-away view of FIG. 13C. A force applied to the first handle lever 1303 applies torque to the stem 1346. A force applied to the second handle lever 1306 is transferred through the lip 1383 of the second handle lever 1306 to the first handle lever 1303 to apply a torque to the stem 1346.

A bushing 1309 is configured to extend through an opening in a wall of a toilet tank. The bushing 1309 includes a stop 1363. The bushing 1209 also includes a passage, a lip, a rectangular segment, a threaded segment as discussed with respect to the example of FIGS. 7A-7F, and possibly other features not discussed in detail herein. The passage extends longitudinally through the bushing 1309 and is configured for the stem 1346 to pass at least partially through the bushing 1309. The stop 1363 extends from the bushing 1309 and is configured to extend through the slot 1343 of the second handle lever 1306 and to abut the shoulder 1329 of the first handle lever 1303 as will be later described. The distal end of the bushing 1309 may also be configured to detachably connect to the actuation control box 113 (FIG. 1).

The portion of the stem 1346 extending from the first handle lever 1303 includes a stem groove 1356 at the distal end. The stem groove 1356 is configured to receive a retaining element 1326 to facilitate securing the first and second handle levers 1303/1306 to the bushing 1309. To this end, with the stem groove 1356 extending through the second handle lever 1306 and the passage of the bushing 1309, the retaining element 1326 may clip to the stem groove 1356 to retain the stem 1346 within the bushing 1309. Thus, the retaining element 1326 may retain the first and second handle levers 1303/1306 to the bushing 1309 in a lateral position, while facilitating rotation of the second handle lever 1306 and/or first handle lever 1303 with respect to the bushing 1309. The distal end of the stem 1346 can be configured to detachably engage a cam of the actuation control box 113 (FIGS. 2A-2C).

The lip of the bushing 1309 is configured to abut an exterior surface of a toilet tank. The rectangular segment is configured to be secured in a corresponding opening in the toilet tank wall, thereby preventing rotational movement of the bushing 1309 with respect to the toilet tank wall. The threaded segment of the bushing 1309 is configured to receive an appropriately threaded nut that abuts an interior surface of the toilet tank wall, thereby preventing translational movement of the bushing 1309 with respect to the toilet tank.

Figure 13D:
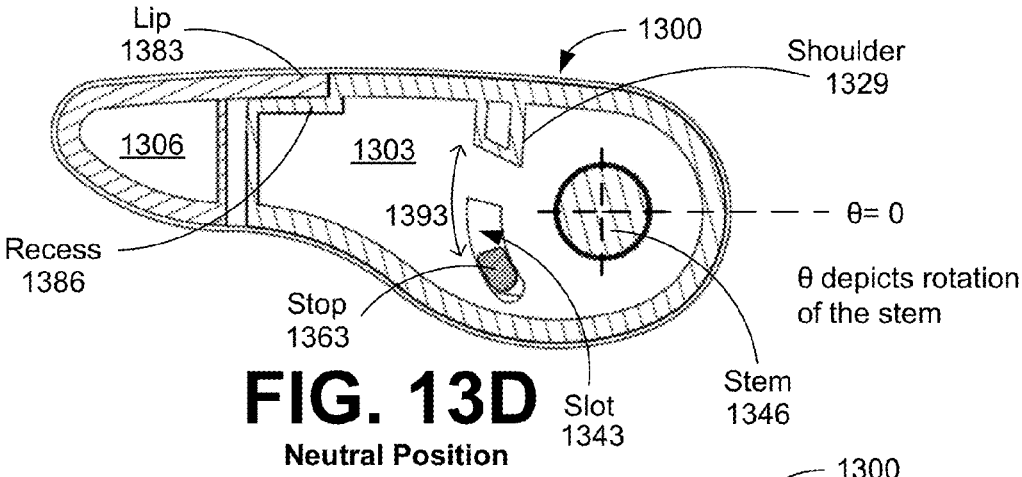
Figure 13E:
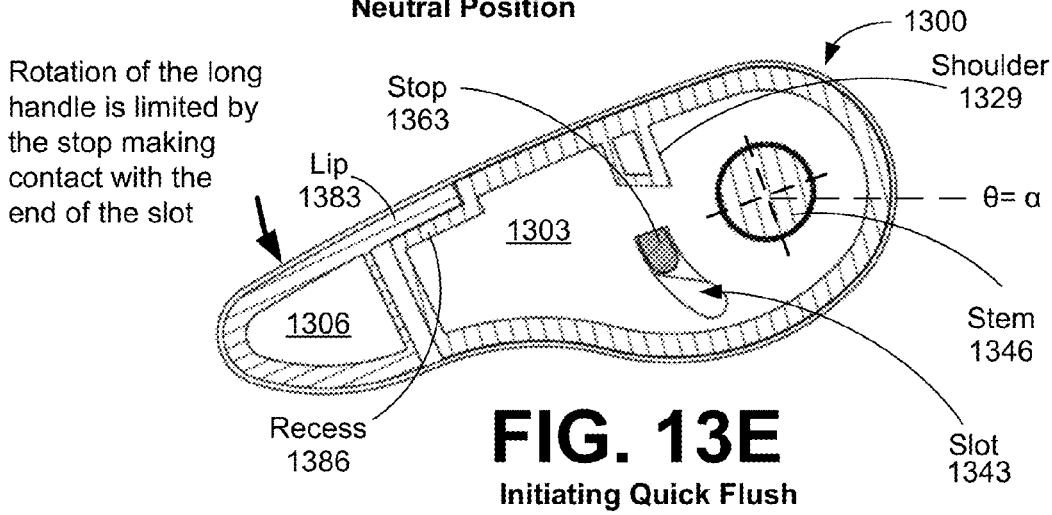
Figure 13F:
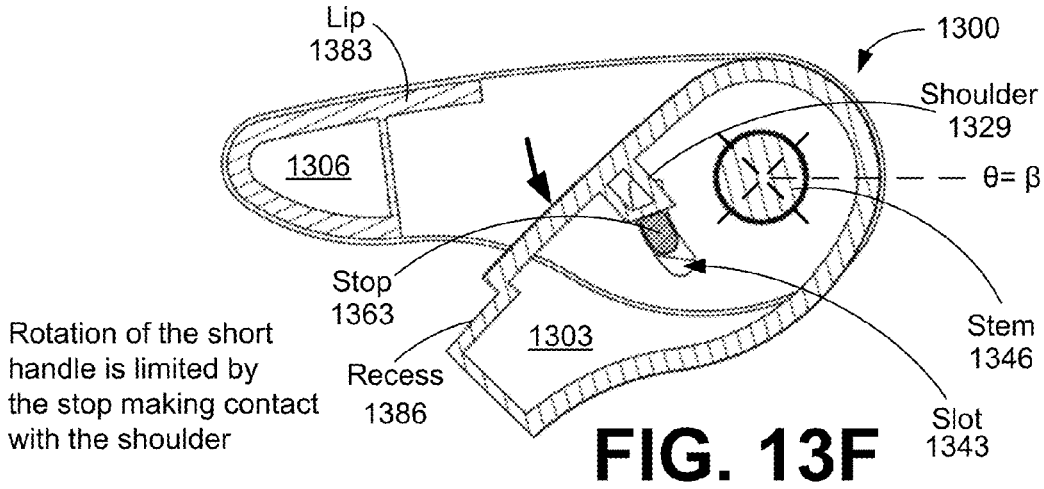

Next, a description of the general operation of the dual flush handle assembly 1300 is provided. FIGS. 13D, 13E, and 13F show progressions of the dual flush handle assembly 1300 being in a neutral position, initiating a partial (or "quick") flush, and initiating a full flush, respectively.

With reference to FIG. 13D, shown is the dual flush handle assembly 1300 in a neutral position according to various embodiments of the present disclosure. The neutral position shown is the position to which the dual flush handle assembly 1300 returns after a flush has been initiated. As shown in FIG. 13D, the shoulder 1329 of the first handle lever 1303 is in line with the slot 1343 of the second handle lever 1306. Also, the stop 1363 of the bushing 1309 extends through the slot 1343 of the second handle lever 1306. As best shown in the cut-away view of FIG. 13D, there is a space 1393 between the stop 1363 and the shoulder 1329. Further, when the dual flush handle assembly 1300 is in the neutral position the shoulder 1329 is located above an upper edge of the slot 1343. Additionally, the stop 1363 of the bushing 1309 is engaged with the lower edge of the slot 1343.

Turning now to FIG. 13E, shown is the dual flush handle assembly 1300 in a position configured to initiate a partial (or "quick") flush of a toilet. The dual flush handle assembly 1300 may arrive in this position, for example, by a user pressing on the second handle lever 1306 as indicated by the arrow. The second handle lever 1306 pushes against the first handle lever 1303 via the lip 1383 and recess 1386 causing the first handle lever 1303, and thus the stem 1346, to rotate and disengage the stop 1363 with the lower edge of the slot 1343. The rotation of the second handle lever 1306 is limited by the upper edge of the slot 1343 of the second handle lever 1306 making contact with the stop 1363 of the bushing 1309. While the second handle lever 1306 stops rotating when the upper edge of the slot 1343 engages with the stop 1363, the first handle lever 1303 may continue to rotate until the shoulder 1329 of the first handle lever 1303 contacts the stop 1363 of the bushing 1309. By rotating the second handle lever 1306 by the amount limited by the slot 1343 and stop 1363, the stem 1346 rotates a predetermined amount to initiate a partial flush, for example, through the actuation control box 113 (FIG. 1) as described above.

After a partial flush has been initiated, the dual flush handle assembly 1300 may automatically return to the neutral position shown in FIG. 13D. To this, end, a spring or other appropriate mechanism may cause the dual flush handle assembly 1300 to return to the neutral position.

Turning to FIG. 13F, shown is the dual flush handle assembly 1300 in a position configured to initiate a full flush of a toilet. The dual flush handle assembly 1300 may arrive in this position, for example, by a user pressing the first handle lever 1303 as indicated by the arrow. By pressing on the first handle lever 1303, the first handle lever 1303 rotates until the shoulder 1329 of the first handle lever 1303 contacts the stop 1363 of the bushing 1309. Thus, the stem 1346 may rotate to initiate a full flush of a toilet, for example, via the actuation control box 113 (FIG. 1).

As best shown in cut-away view of FIG. 13F, the stop 1363 engages with the shoulder 1329 of the first handle lever 1306. Thus, the shoulder 1329 in conjunction with the stop 1363 acts to define the predetermined angle of rotation. As shown in FIGS. 13E and 13F, the angle $\alpha$ denotes the angle of rotation that the first and second handle levers 1303/1306 have rotated from the neutral position. Similarly, the angle $\beta$ shows the angle of rotation that the first handle lever 1303 has rotated from the neutral position to the full flush position.

After a full flush has been initiated, the dual flush handle assembly 1300 may automatically return to the neutral position shown in FIG. 13D. To this end, a spring or other appropriate mechanism may return the dual flush handle assembly 1300 to the neutral position. In alternative embodiments, the dual flush handle assembly 1300 may return to the neutral position using other mechanisms. As non-limiting examples, the dual flush handle assembly 1300 may return to the neutral position due its own weight, from a flush valve dropping due to a drop in water level in the toilet tank, from a spring force inside the activation control box 113 (FIG. 1), from a spring force associated with a flush valve, or from any other mechanism.

Figure 14A:
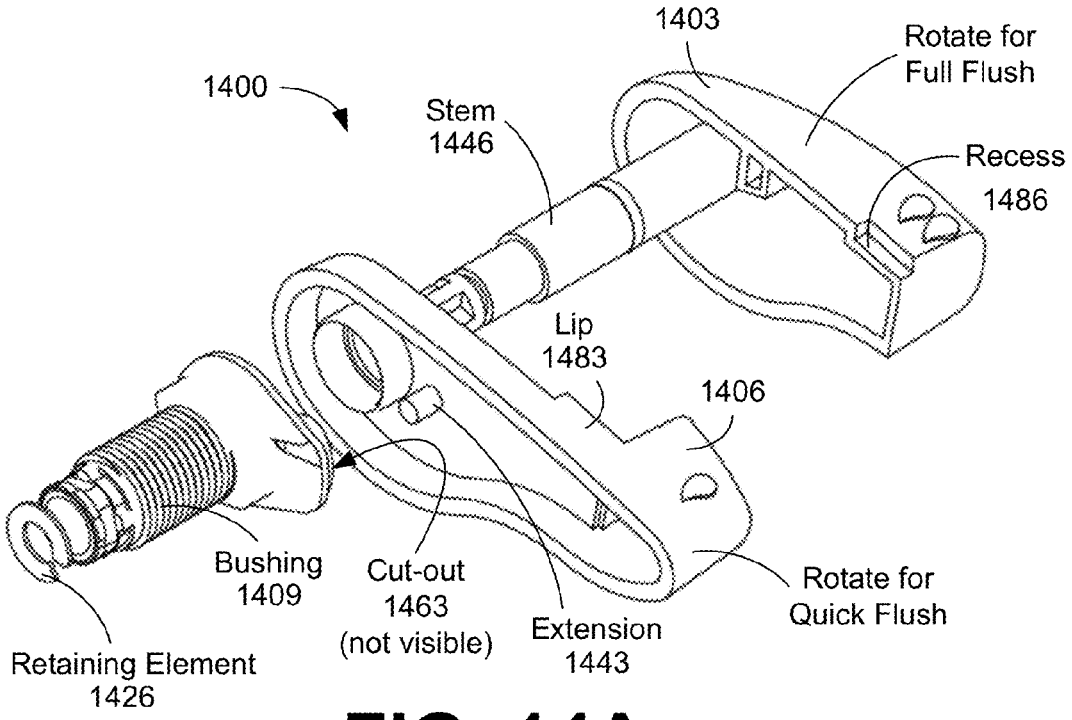

Referring next to FIGS. 14A-14D, shown is another example of a dual flush handle assembly 1400. The dual flush handle assembly 1400 may be used to initiate a partial flush and/or a full flush of a toilet. To this end, the dual flush handle assembly 1400 may be in communication with, for example, the actuation control box 113 (FIG. 1). FIG. 14A shows an exploded view of the dual flush handle assembly 1400. The dual flush handle assembly 1400 includes a first handle lever 1403, a second handle lever 1406, a bushing 1409, and other components such as, e.g., springs, retaining elements, and/or damper as discussed with respect to the dual flush handle assembly 600 of FIGS. 3A-3D.

The first handle lever 1403 is shaped to be nested within the second handle lever 1406. In this sense, the first handle lever 1403 and second handle lever 1406 are formed to facilitate at least a portion of the first handle lever 1403 "fitting" within a portion of the second handle lever 1406. The second handle lever 1406 may fit within a profile of the first handle 1403 so as to promote the appearance of a single handle. Accordingly, the dual flush handle assembly 1400 may present an appearance of a conventional toilet flush lever, while providing the functionality of a dual flush handle control.

The first handle lever 1403 is configured to rotate about an axis, which may be limited to a predetermined angle of rotation by the rotational range within the bushing and/or by the actuation control box 113 (FIG. 1). The second handle lever 1406 is also configured to rotate about an axis by a predetermined angle of rotation. It is emphasized that the second handle lever 1406 may rotate by a predetermined angle of rotation that is different than the angle of rotation of the first handle lever 1403. The second handle lever 1406 includes an extension 1443 that extends outward from the toilet-facing side or surface of the second handle lever 1406. The second handle lever 1406 also includes a lip (or tab) 1483 that engages with a recess 1486 of the first handle lever 1403. Rotation of the second handle lever 1406 engages the lip 1483 with the recess 1486 to cause corresponding rotation of the first handle lever 1403. The first handle lever 1403 may be rotated without producing a corresponding rotation of the second handle lever 1406. When the first handle lever 1403 is rotated, the lip 1483 is disengaged from the recess 1486, allowing the second handle lever 1406 to remain stationary.

A stem 1446 is attached to the first handle lever 1403 to extend outward from the toilet-facing side or surface of the first handle lever 1403. For example, the stem 1446 may be integrally cast with the first handle lever 1403 as illustrated in the cut-away view of FIG. 13C. A force applied to the first handle lever 1403 applies torque to the stem 1446. A force applied to the second handle lever 1406 is transferred through the lip 1483 to the first handle lever 1403 to apply a torque to the stem 1446.

A bushing 1409 is configured to extend through an opening in a wall of a toilet tank. The bushing 1409 includes a cut-out 1463. The bushing 1409 also includes a passage, a lip, a rectangular segment, a threaded segment as discussed with respect to the example of FIGS. 7A-7F, and possibly other features not discussed in detail herein. The passage extends longitudinally through the bushing 1409 and is configured for the stem 1446 to pass at least partially through the bushing 1409. The cut-out 1463 includes a slot configured to receive the extension 1443 of the second handle lever 1406 (similar to cut-out 1163 of FIG. 11A). The distal end of the bushing 1409 may also be configured to detachably connect to the actuation control box 113 (FIG. 1).

The portion of the stem 1446 extending from the first handle lever 1403 includes a stem groove at the distal end. The stem groove is configured to receive a retaining element 1426 to facilitate securing the first and second handle levers 1403/1406 to the bushing 1409. To this end, with the stem groove extending through the second handle lever 1406 and the passage of the bushing 1409, the retaining element 1426 may clip to the stem groove to retain the stem 1446 within the bushing 1409. Thus, the retaining element 1426 may retain the first and second handle levers 1403/1406 to the bushing 1409 in a lateral position, while facilitating rotation of the second handle lever 1406 and/or first handle lever 1403 with respect to the bushing 1409. The distal end of the stem 1446 can be configured to detachably engage a cam of the actuation control box 113 (FIGS. 2A-2C).

The lip of the bushing 1409 is configured to abut an exterior surface of a toilet tank. The rectangular segment is configured to be secured in a corresponding opening in the toilet tank wall, thereby preventing rotational movement of the bushing 1409 with respect to the toilet tank wall. The threaded segment of the bushing 1409 is configured to receive an appropriately threaded nut that abuts an interior surface of the toilet tank wall, thereby preventing translational movement of the bushing 1409 with respect to the toilet tank.

Figure 14B:
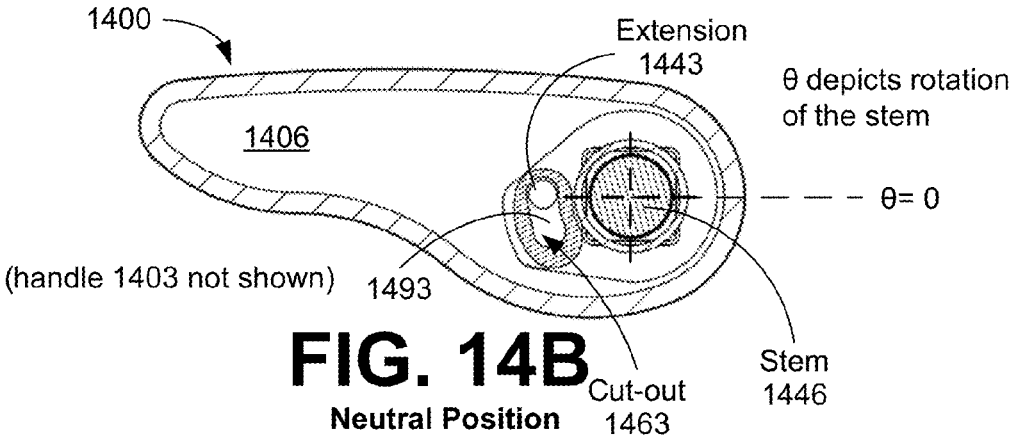
Figure 14C:
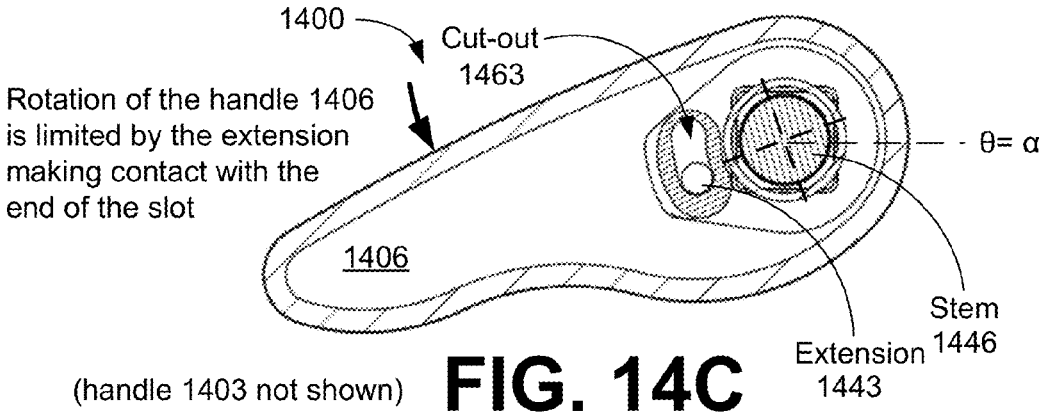
Figure 14D:
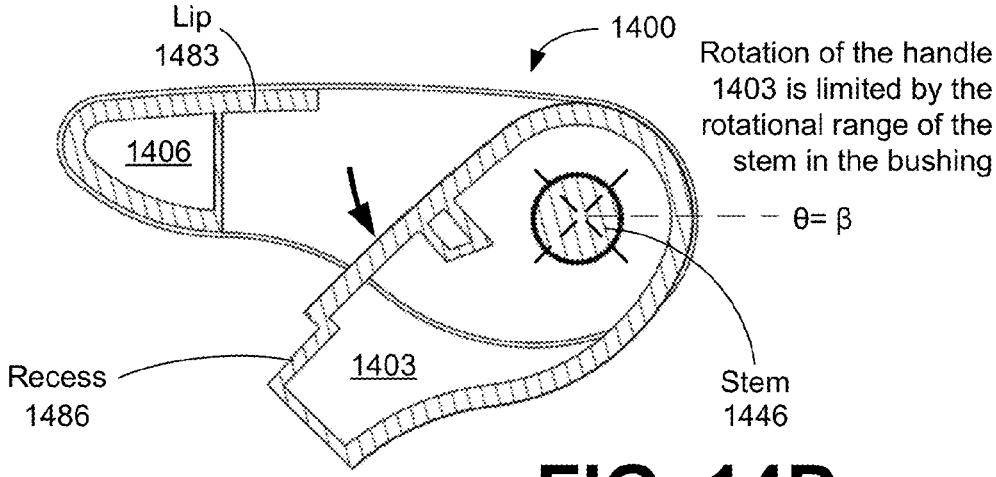

Next, a description of the general operation of the dual flush handle assembly 1400 is provided. FIGS. 14B, 14C, and 14D show progressions of the dual flush handle assembly 1400 being in a neutral position, initiating a partial (or "quick") flush, and initiating a full flush, respectively.

With reference to FIG. 14B, shown is the dual flush handle assembly 1400 in a neutral position according to various embodiments of the present disclosure. The neutral position shown is the position to which the dual flush handle assembly 1400 returns after a flush has been initiated. The extension 1443 of the second handle lever 1406 extends into the cut-out 1463 of the bushing 1409. As best shown in the cut-away view of FIG. 14B, there is a space 1493 between the extension 1443 and the lower edge of the cut-out 1463.

Turning now to FIG. 14C, shown is the dual flush handle assembly 1400 in a position configured to initiate a partial (or "quick") flush of a toilet. The dual flush handle assembly 1400 may arrive in this position, for example, by a user pressing on the second handle lever 1406 as indicated by the arrow. The second handle lever 1406 pushes against the first handle lever 1403 via the lip 1483 and recess 1486 causing the first handle lever 1403, and thus the stem 1446, to rotate. The rotation of the second handle lever 1406 is limited by the lower edge of the cut-out 1463 of the bushing 1409 making contact with the extension 1463 of the second handle lever 1406. While the second handle lever 1406 stops rotating when the lower edge of the extension 1443 engages with the cut-out 1463, the first handle lever 1403 may continue to rotate. By rotating the second handle lever 1406 by the amount limited by the extension 1443 and cut-out 1463, the stem 1446 rotates a predetermined amount to initiate a partial flush, for example, through the actuation control box 113 (FIG. 1) as described above.

After a partial flush has been initiated, the dual flush handle assembly 1400 may automatically return to the neutral position shown in FIG. 14B. To this, end, a spring or other appropriate mechanism may cause the dual flush handle assembly 1400 to return to the neutral position.

Turning to FIG. 14D, shown is the dual flush handle assembly 1400 in a position configured to initiate a full flush of a toilet. The dual flush handle assembly 1400 may arrive in this position, for example, by a user pressing the first handle lever 1403 as indicated by the arrow. By pressing on the first handle lever 1403, the first handle lever 1403 rotates until the bushing 1309 and/or actuation control box 113 (FIG. 1) limit rotation. Thus, the stem 1346 may rotate to initiate a full flush of a toilet, for example, via the actuation control box 113. As shown in FIGS. 14C and 14D, the angle $\alpha$ denotes the angle of rotation that the first and second handle levers 1403/1406 have rotated from the neutral position. Similarly, the angle $\beta$ shows the angle of rotation that the first handle lever 1403 has rotated from the neutral position to the full flush position.

After a full flush has been initiated, the dual flush handle assembly 1400 may automatically return to the neutral position shown in FIG. 14B. To this end, a spring or other appropriate mechanism may return the dual flush handle assembly 1400 to the neutral position. In alternative embodiments, the dual flush handle assembly 1400 may return to the neutral position using other mechanisms. As non-limiting examples, the dual flush handle assembly 1400 may return to the neutral position due its own weight, from a flush valve dropping due to a drop in water level in the toilet tank, from a spring force inside the activation control box 113 (FIG. 1), from a spring force associated with a flush valve, or from any other mechanism.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It is noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

Therefore, the following is claimed:

1. An apparatus, comprising:

a first handle lever configured to rotate in a direction about an axis, the first handle lever comprising a shoulder on an interior side of the first handle lever;

a second handle lever configured to rotate in the direction about the axis, the second handle lever comprising a slot; and a stop extending through the slot, wherein the stop is configured to engage the shoulder of the first handle lever upon rotating the first handle lever by a first angle of rotation.

2. The apparatus of claim 1, wherein the stop is configured to engage an edge of the slot upon rotating the second handle lever by a second angle of rotation.

3. The apparatus of claim 2, wherein the first angle of rotation is less than the second angle of rotation.

4. The apparatus of claim 2, wherein the first angle of rotation is greater than the second angle of rotation.

5. The apparatus of claim 1, further comprising a damper disposed between the first handle lever and the second handle lever.

6. The apparatus of claim 1, wherein at least a portion of the first handle lever is nested in at least a portion of the second handle lever.

7. The apparatus of claim 1, further comprising a bushing configured to extend through a wall of a toilet tank, the bushing including the stop.

8. The apparatus of claim 7, wherein the second handle lever further comprises a stem extending from an interior side of the second handle lever, wherein the stem is retained in the bushing.

9. The apparatus of claim 8, wherein the stem further comprises a groove configured to receive a retaining element.

10. The apparatus of claim 8, wherein the first handle lever is secured to the second handle lever.

11. The apparatus of claim 7, wherein the first handle lever further comprises a stem extending from an interior side of the first handle lever through an opening of the second handle lever, wherein the stem is retained in the bushing.

12. The apparatus of claim 7, wherein the bushing further comprises a groove configured to receive a retaining element.

13. The apparatus of claim 1, further comprising a spring configured to return the first handle lever and the second handle lever to a neutral position after a flush activation.

14. The apparatus of claim 1, further comprising a spring configured to rotate the first handle lever towards the second handle lever.

15. The apparatus of claim 1, wherein the second handle lever includes a lip configured to engage a recess of the first handle lever when the second handle lever is rotated.

16. An apparatus, comprising:

a first handle lever configured to rotate in a direction about an axis, the first handle lever comprising an extension extending from an interior side of the first handle lever;

a second handle lever configured to rotate in the direction about the axis, where rotation of the first handle lever produces corresponding rotation of the second handle lever; and a bushing comprising a cut-out, wherein the extension is configured to engage the cut-out of the bushing upon rotating the first handle lever by a first angle of rotation.

17. The apparatus of claim 16, wherein the second handle lever comprises a slot, wherein the extension extends through the slot.

18. The apparatus of claim 17, wherein the extension is configured to engage an edge of the slot upon rotating the second handle lever by a second angle of rotation.

19. The apparatus of claim 16, wherein the second handle lever includes a lip configured to engage a recess of the first handle lever when the second handle lever is rotated.

20. The apparatus of claim 16, wherein at least a portion of the first handle lever is nested in at least a portion of the second handle lever.

* * * * *